US010487543B2

(12) United States Patent
Sanford et al.

(10) Patent No.: US 10,487,543 B2
(45) Date of Patent: Nov. 26, 2019

(54) LOCKING DEVICE WITH ANTI-JAM MECHANISM

(71) Applicant: Master Lock Company, Oak Creek, WI (US)

(72) Inventors: Eric Sanford, Oak Creek, WI (US); Evan P. Thompson, Oak Creek, WI (US); Glenn Brown, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 15/640,011

(22) Filed: Jun. 30, 2017

(65) Prior Publication Data

US 2019/0003206 A1 Jan. 3, 2019

(51) Int. Cl.
*E05B 47/00* (2006.01)
*E05B 17/22* (2006.01)
(Continued)

(52) U.S. Cl.
CPC ..... *E05B 47/0012* (2013.01); *E05B 15/04* (2013.01); *E05B 17/226* (2013.01);
(Continued)

(58) Field of Classification Search
CPC .... E05B 47/00; E05B 47/0012; E05B 47/026; E05B 47/0607; E05B 63/18; E05B 15/04;
(Continued)

(56) References Cited

U.S. PATENT DOCUMENTS 5,473,922 A 12/1995 Bair et al.
8,069,693 B2 * 12/2011 Powers ..... E05B 39/005 292/259 R
(Continued)

FOREIGN PATENT DOCUMENTS

EP 2 711 490 A1 3/2014
GB 2 439 477 A 12/2007
(Continued)

OTHER PUBLICATIONS

International Search Report and Written Opinion, PCT/US2018/040307, 19 pages (dated Dec. 13, 2018).

*Primary Examiner* — Suzanne L Barrett
(74) *Attorney, Agent, or Firm* — Foley & Lardner LLP

(57) ABSTRACT

Embodiments provide a lock including an actuator that is movable between an unlocked position and a locked position, and a bolt that is movable between an extended bolt position and a retracted bolt position independent of the position of the actuator. In the extended bolt position, the bolt extends outside a body of the lock. A coupling element is arranged between the actuator and the bolt and is movable between an extended coupling position and a retracted coupling position in response to movement of the actuator between the locked position and the unlocked position. A first biasing element biases the coupling element toward the retracted coupling position, and a second biasing element couples the coupling element to the bolt and is structured to bias the bolt away from the coupling element and towards the extended bolt position.

18 Claims, 24 Drawing Sheets

(51) Int. Cl.

| | |
|---|---|
| ***E05B 47/06*** | (2006.01) |
| ***E05B 65/02*** | (2006.01) |
| ***G07C 9/00*** | (2006.01) |
| ***E05B 47/02*** | (2006.01) |
| ***E05B 15/04*** | (2006.01) |
| *E05B 63/18* | (2006.01) |

(52) U.S. Cl.
CPC ..... *E05B 47/026* (2013.01); *E05B 47/0607* (2013.01); *E05B 65/025* (2013.01); *G07C 9/00111* (2013.01); *G07C 9/00182* (2013.01); *E05B 63/18* (2013.01); *E05B 2047/0024* (2013.01); *E05B 2047/0031* (2013.01); *E05B 2047/0069* (2013.01); *E05B 2047/0095* (2013.01)

(58) Field of Classification Search
CPC ..... E05B 17/226; E05B 65/025; E05B 2047/0024; E05B 2047/0031; E05B 2047/0069; E05B 2047/0095; G07C 9/00111; G07C 9/00182
USPC ..... 70/278.1–278.7, 333 R
See application file for complete search history.

(56) References Cited

U.S. PATENT DOCUMENTS

| | | | | |
|---|---|---|---|---|
| 2010/0109349 | A1* | 5/2010 | Peabody | E05B 47/0002 292/194 |
| 2015/0292245 | A1* | 10/2015 | Miller | E05B 47/0603 70/134 |
| 2016/0060904 | A1* | 3/2016 | Dore Vasudevan | E05B 47/0673 292/144 |
| 2017/0321453 | A1* | 11/2017 | Zheng | E05B 55/06 |
| 2018/0051486 | A1* | 2/2018 | Yuan | E05B 17/2034 |

FOREIGN PATENT DOCUMENTS

| | | | |
|---|---|---|---|
| WO | WO-2004/020769 | A1 | 3/2004 |
| WO | WO-2016/042183 | A1 | 3/2016 |

* cited by examiner

| STATES | | | |
|---|---|---|---|
| 1 | 2 | DESCRIPTION | OUTPUT |
| U | ← | UNLOCKED | 156 |
| U | → | RETRACTION PREVENTED | 160 |
| L | ← | EXTENSION PREVENTED | 164 |
| L | → | LOCKED | 168 |

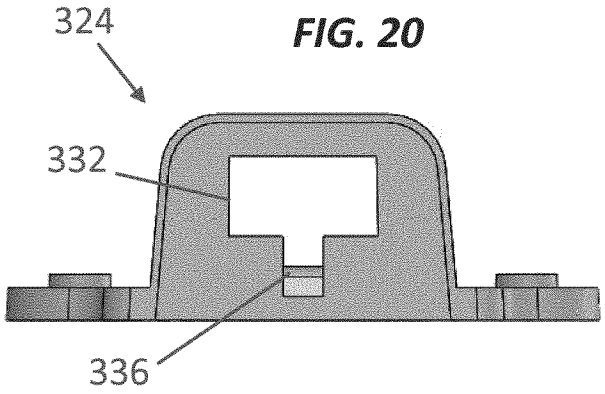
FIG. 20
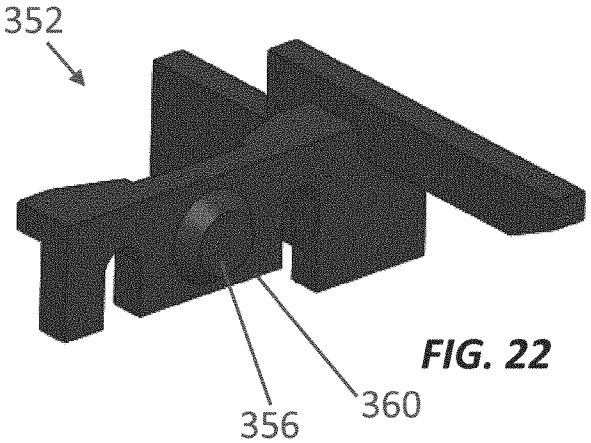
FIG. 22
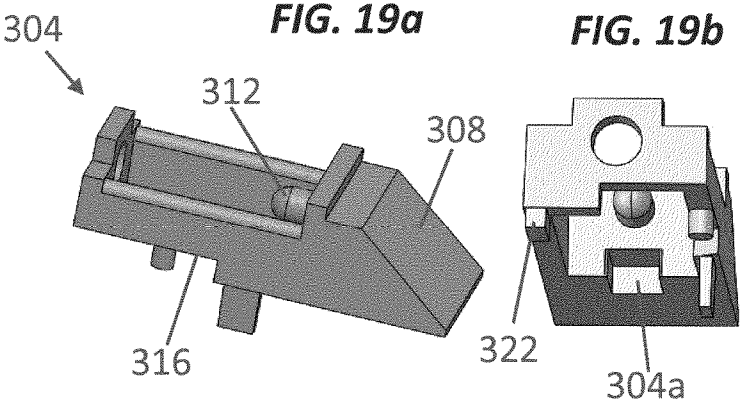
FIG. 19a
FIG. 19b
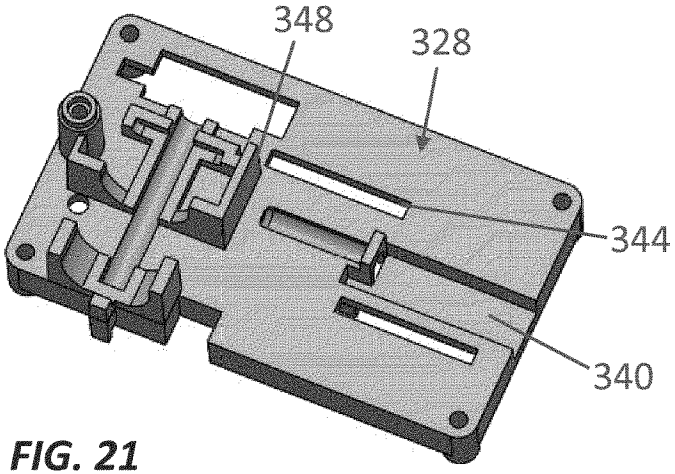
FIG. 21

LOCKING DEVICE WITH ANTI-JAM MECHANISM

BACKGROUND

The present disclosure relates generally to the field of locking devices. According to some embodiments, the disclosure relates to locking devices, such as electronic locks for lockers, that include features designed to avoid jamming of locking elements.

Electronic locking devices operate conveniently for users. In some such devices, users may enter a code or interact with the lock in some other manner, and the lock can automatically transition from a locked to an unlocked state or from an unlocked to a locked state. One problem that can arise when utilizing electronic locks is that a locking element, such as bolt mechanism of an electronic locker lock, can jam. In some circumstances, this can cause the user to believe the locking element is secured in the locked position when it is not, or cause difficulty for the user in successfully placing the lock in the locked or unlocked state.

SUMMARY

One embodiment of the disclosure relates to a lock that includes an actuator that is movable between an unlocked position and a locked position, and a bolt that is movable between an extended bolt position and a retracted bolt position independent of the position of the actuator. In the extended bolt position, the bolt extends outside a body of the lock. A coupling element is arranged between the actuator and the bolt and is movable between an extended coupling position and a retracted coupling position in response to movement of the actuator between the locked position and the unlocked position. A first biasing element biases the coupling element toward the retracted coupling position, and a second biasing element couples the coupling element to the bolt and is structured to bias the bolt away from the coupling element and towards the extended bolt position.

Another embodiment of the disclosure relates to an electronic locker lock that includes an interface assembly including a user input device, a controller, and a display providing user feedback. A latching assembly includes a power source, an actuator movable between a locked position and an unlocked position, a bolt actuatable between an extended bolt position and a retracted bolt position independent of the position of the actuator, and a coupling element coupled between the actuator and the bolt and arranged to urge the bolt toward the retracted bolt position when the actuator is arranged in the unlocked position and to urge the bolt toward the extended bolt position when the actuator is arranged in the locked position.

Another embodiment of the disclosure relates to an electronic locker lock that includes an interface assembly including a user input device, a controller, and a display providing user feedback, and a latching assembly. The latching assembly includes a power source, an actuator movable between an unlocked position and a locked position, a bolt movable between an extended bolt position and a retracted bolt position independent of the position of the actuator, wherein, in the extended bolt position, the bolt extends outside a body of the lock, a coupling element arranged between the actuator and the bolt and movable between an extended coupling position and a retracted coupling position in response to movement of the actuator between the locked position and the unlocked position, a first biasing element biasing the coupling element toward the retracted coupling position, and a second biasing element coupling the coupling element to the bolt and structured to bias the bolt away from the coupling element and towards the extended bolt position. A first sensor is structured to communicate an actuator position signal to the controller, a first bolt position sensor is structured to communicate a first bolt position signal to the controller indicating the bolt is arranged in the unlocked position, and a second bolt position sensor is structured to communicate a second bolt position signal to the controller indicating the bolt is arranged in the locked position.

BRIEF DESCRIPTION OF THE DRAWINGS

FIG. 19*a* is a pictorial view of a bolt of the push to close lock of FIG. 18 according to one construction.

FIG. 19*b* is a pictorial view of the bolt of FIG. 19*a* according to one construction.

FIG. 20 is a right side view of a faceplate of the push to close lock of FIG. 18 according to one construction.

FIG. 21 is a pictorial view of a frame of the push to close lock of FIG. 18 according to one construction.

FIG. 22 is a pictorial view of a coupling element of the push to close lock of FIG. 18 according to one construction.

DETAILED DESCRIPTION

Before turning to the figures, which illustrate the exemplary constructions in detail, it should be understood that the application is not limited to the details or methodology set forth in the description or illustrated in the figures. It should also be understood that the terminology is for the purpose of description only and should not be regarded as limiting.

Referring generally to the figures, varying systems and methods for locking a door (e.g., a door of a locker) or other component are shown and described. According to some embodiments, a lock can include an interface assembly that a user can interact with to move the lock between a locked position and an unlocked position. The interface assembly can include a display and a keypad. The display can provide user feedback regarding jam conditions, vacancy, locked/unlocked status, access code requirements, or other feedback. In some embodiments, the display can be constructed using electrophoretic technology.

The lock can also include a latching assembly that actuates a bolt between the locked position and the unlocked position. The latching assembly includes an actuator and a spring loaded coupling member arranged between the actuator and the bolt. The coupling member is arranged such that if the bolt is stuck or jammed in the unlocked position (i.e., a first jam condition where the bolt is retracted) the actuator can still be actuated to the locked position without detriment or damage to the actuator or generating excessive force that may make it difficult for a user to clear the jam. The coupling member is also arranged such that if the bolt is stuck or jammed in the locked position (i.e., a second jam condition where the bolt is extended) the actuator can still be actuated to the unlocked position without detriment or damage to the actuator. The coupling member allows the lock to function normally once a jam condition is addressed (e.g., removing a blockage) and inhibits damage to internal components of the latching assembly.

Figure 1:
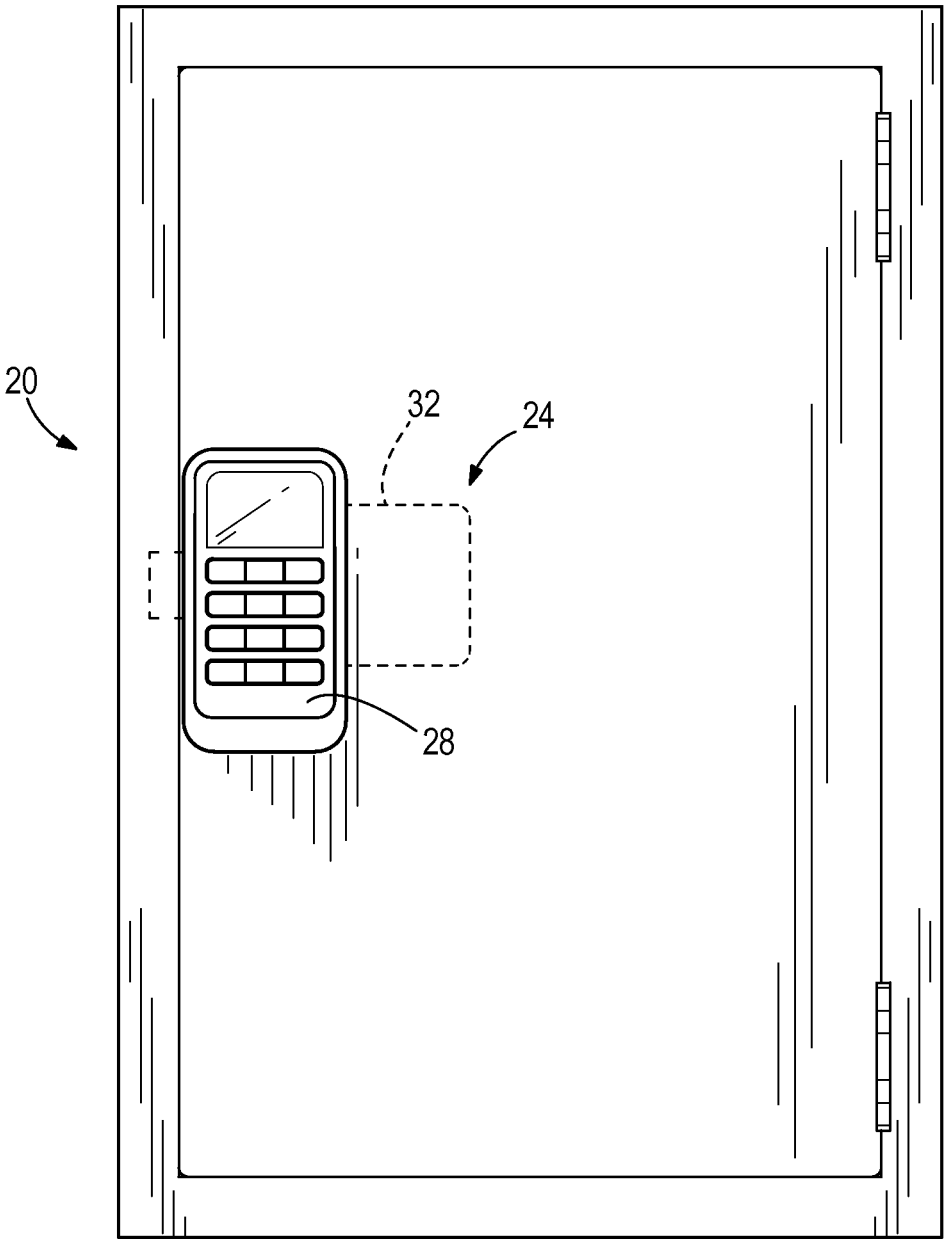
FIG. 1 is a front view of a locker including a lock according to one construction.

As shown in FIG. 1, a door 20 is movable between an open position and a closed position (shown in FIG. 1) to provide selective access to a locker and includes a lock 24. The lock 24 is actuatable between an unlocked position and a locked position, to selectively allow and inhibit access to an interior of the locker. The lock 24 includes an interface assembly 28 positioned on an exterior surface of the door 20, and a latching assembly 32 positioned on an interior surface of the door 20. In other constructions, the interface assembly 28 and/or the latching assembly may be built into or otherwise integrated with the door 20.

Figure 2:
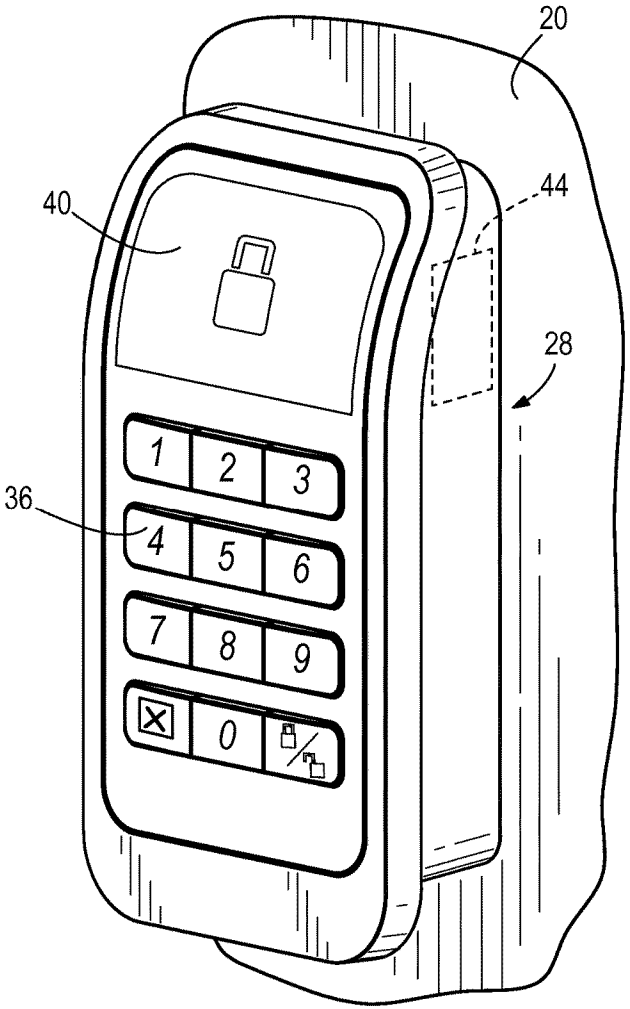
FIG. 2 is a pictorial view of an interface assembly of the lock of FIG. 1.

As shown in FIG. 2, the interface assembly 28 includes a user interface in the form of a keypad 36 and a display 40. A controller 44 is disposed within the interface assembly and communicates with the keypad 36 and the display 40. In one embodiment, the controller is mounted on a printed circuit board assembly (PCB-A). In other constructions, the user interface may include different keys, may eliminate the keypad 36, may include a wireless communications device (e.g., a Bluetooth® communications device, a Wi-Fi communications device, an RFID communication device), may include an application installed on a mobile device, or may include other features arranged to provide communication between the interface assembly 28 and a user. In some implementations, the controller 44 may include a processor (e.g., an ASIC, FPGA, and/or any other type of processing circuit) and a memory (e.g., RAM, ROM, flash memory, and/or any other type of machine-readable storage medium. In some such implementations, operations of a locking device such as those discussed herein may be implemented by the processor upon executing machine-readable instructions stored in the memory.

Figure 3:
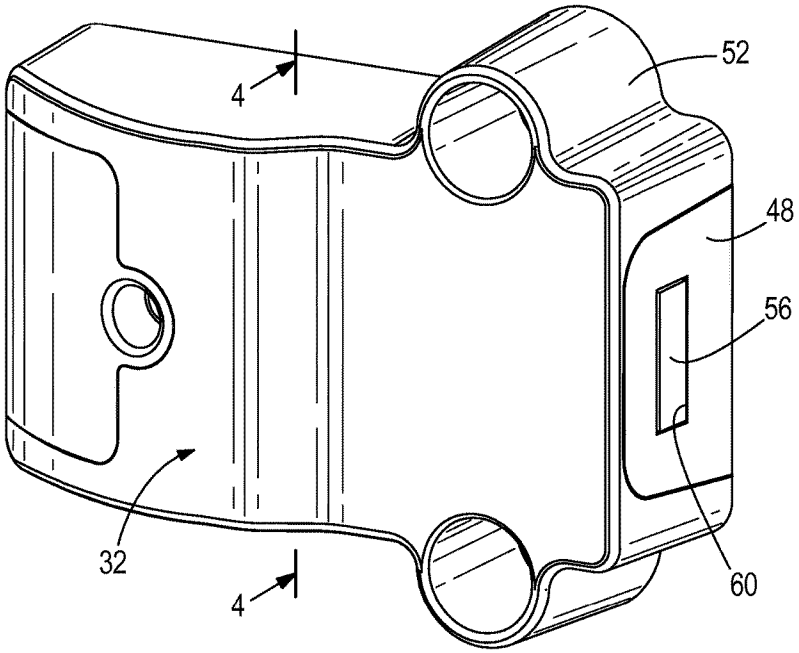
FIG. 3 is a pictorial view of a latching assembly of the lock of FIG. 1.

As shown in FIG. 3, the latching assembly 32 includes a latching assembly housing or body 48 and a cover 52 coupled to the body 48 and arranged to inhibit access to components of the latching assembly 32. The latching assembly 32 also includes a bolt 56 arranged within a bolt aperture 60 formed in the body 48. In other constructions, the body 48 may be formed as a part of the door 20 or may be eliminated. The cover 52 may define a different shape or may be eliminated (e.g., in an exemplary construction where the latching assembly resides within the door 20). In other implementations, the latching assembly may use a latching element other than a bolt.

Figure 4:
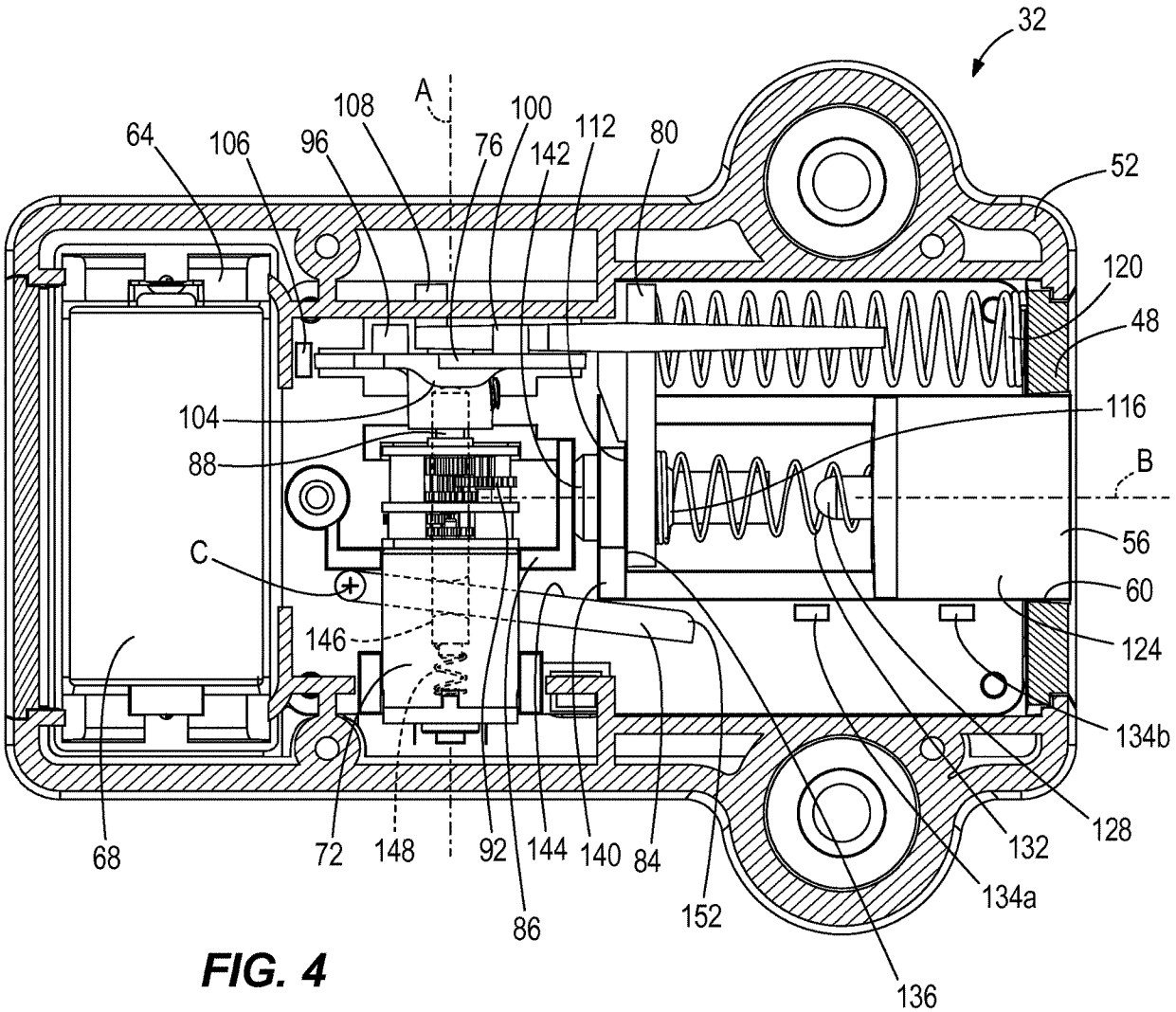
FIG. 4 is a section view of the latching assembly taken along line 4-4 of FIG. 3 showing the latching assembly arranged in an unlocked position.

As shown in FIG. 4, in some embodiments, the latching assembly 32 also includes a battery housing 64 that may be formed as a part of the body 48 or as a separate part and is arranged to receive batteries 68. In various embodiments, the lock 24 may be powered via disposable batteries, rechargeable batteries (e.g., Li-ion or NiMH batteries), or another type of energy storage device (e.g., capacitor banks). An actuator in the form of a motor 72 and a cam head 76 is arranged in the body 48 and the batteries 68 provide power to the interface assembly 28 so that the controller 44 selectively operates the motor 72. In some constructions, the controller 44 is arranged as a part of the latching assembly 32 and is located within the body 48. The latching assembly further includes a coupling element 80 that is arranged to selectively actuate the bolt 56 in response to urging by the cam head 76, and a deadlocking lever 84 arranged to selectively inhibit the bolt for retracting into the body 48.

In the illustrated embodiment, the motor 72 is supported by a motor mount 86 and is arranged to rotate in a single direction (e.g., clockwise) during actuation between the unlocked position and the locked position. In one construction the motor 72 is a stepper motor that is controlled by the controller 44. In other constructions, the motor 72 may be a servo motor or another type of motor, as desired. The motor includes a shaft 88 that extends through a support or bearing 92 and is received by the cam head 76.

Figure 6:
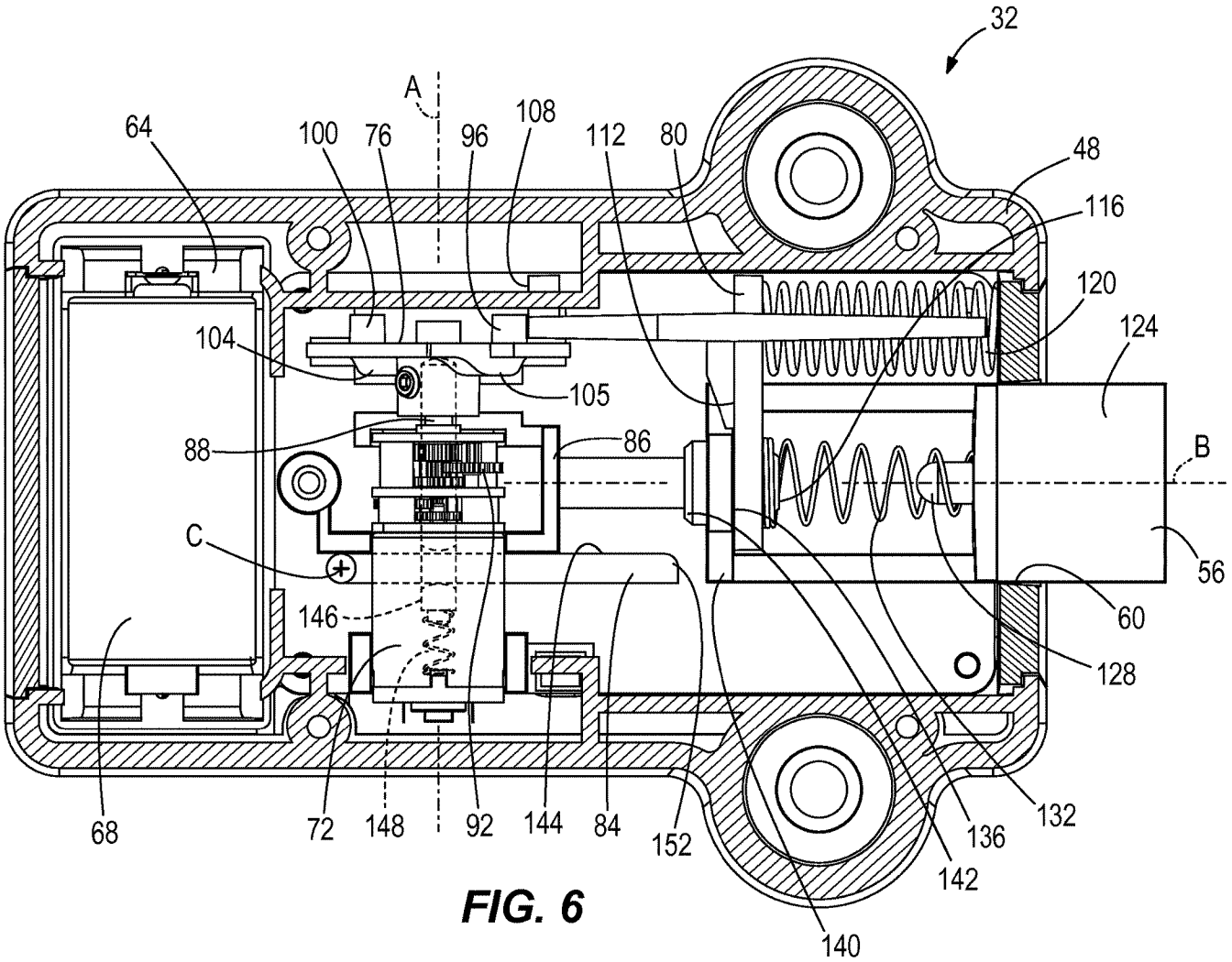
FIG. 6 is a section view of the latching assembly taken along line 4-4 of FIG. 3 showing the latching assembly arranged in a locked position.

The cam head 76 defines a bolting cam profile in the form of a first protrusion 96 and a second protrusion 100, and a deadlock cam profile in the form of a third protrusion 104 and a fourth protrusion 105 (not visible in FIG. 4, see FIG. 6). The cam head 76 is rigidly coupled to the shaft 88 such that relative rotation between the shaft 88 and the cam head 76 is eliminated. In the illustrated construction the shaft 88 defines a D-shaped key and a setscrew engages the cam head 76 and the shaft 88. In other constructions, a spline, a keyway, a different key shape, a bolt, adhesive, or another coupling mechanism may be used, as desired. The shaft 88 and the cam head 76 are arranged to rotate about an actuator axis A.

In the illustrated construction, the first protrusion 96 and the second protrusion 100 of the bolting cam profile are arranged symmetrically about the actuator axis A one-hundred-eighty degrees apart from one another and define a cylindrical shape. In other constructions, the first protrusion 96 and the second protrusion 100 may define different shapes or may be arranged differently relative to one another. For example, the bolting cam profile may include three or more protrusions, or less than two protrusions. Additionally, the bolting cam profile may define different profiles such as step profiles, curved profiles, linear profiles, etc.

In the illustrated construction, the third protrusion 104 and the fourth protrusion 105 of the deadlock cam profile are arranged symmetrically about the actuator axis A one-hundred-eighty degrees apart from one another and define a ramped shape. In other constructions, the third protrusion 104 and the fourth protrusion 105 may define different shapes or may be arranged differently relative to one another. For example, the deadlock cam profile may include three or more protrusions, or less than two protrusions. Additionally, the deadlock cam profile may define different profiles such as step profiles, curved profiles, linear profiles, etc.

In some embodiments, the cam head 76 is rotated approximately ninety degrees with each movement or step of the motor 72, such that four movements or steps are used to rotate the cam head 76 a full three-hundred-sixty degree rotation. In such embodiments, two locking cycles (e.g., during which the actuator is moved between the unlocked position and the locked position and back to an original position) may be completed with each full rotation, such that the first protrusion 96 contacts the coupling element 80 during the first locking cycle and the second protrusion 100 contacts the coupling element 80 during the second locking cycle.

In some implementations, a configuration such as that illustrated in FIG. 4 and other figures of the present disclosure may help prolong the life of the lock and/or the batteries. For example, such a configuration may allow for the use of a small motor (e.g., small brushed DC motor with integrated gear reduction). Moving the motor in a single direction, such that elements such as springs drive some elements in one direction and the motor is not responsible for actuation in both directions, may allow for a smaller motor to be used to accomplish the same functionality. This may extend the life of the motor and other components of the device and provide for lower maintenance. Additionally, battery consumption may be lower due to the smaller motor and less work on the motor. In some embodiments, using a configuration such as that illustrated in the present figures may allow for up to a forty percent reduction in the work performed by the motor as compared to a motor that actuates the elements in both directions (e.g., moves back and forth). Further, the configuration described herein allows the bolt 56 to actuate faster in one direction (e.g., in the unlocking direction). In some embodiments, the locking cycle takes about one second (1 s), and the unlocking cycle takes about two-tenths of a second (0.2 s).

A rotational position sensor 106 can be arranged near to (e.g., adjacent) the cam head 76 and is in communication with the controller 44. The rotational position sensor 106 provides signals to the controller 44 indicative of the position of the cam head 76. In some embodiments, a first signal represents the cam head 76 is in the unlocked cam position, and a second signal indicates that the cam head 76 is in the locked cam position.

The coupling element 80 includes a cam follower in the form of a follower shoulder 108, an unlocking feature in the form of an unlocking coupling surface 112, and a locking feature in the form of a coupling protrusion 116. The coupling element 80 is arranged to move between a retracted coupling position (as shown in FIG. 4), and an extended coupling position (as shown in FIG. 6). A coupling biasing element in the form of a coupling spring 120 is arranged between the coupling element 80 and the body 48 and biases the coupling element 80 toward the retracted coupling position. In other constructions, the cam follower defines a different profile such as a curved profile or a step profile.

The bolt 56 (alternatively called a blocker) is actuatable between a retracted bolt position (as shown in FIG. 4) and an extended bolt position (as shown in FIG. 6) along a bolt axis B that is substantially perpendicular to the actuator axis A. The bolt 56 includes a latching portion 124 that extends beyond the body 48 through the bolt aperture 60 when the lock is arranged in the locked position (as shown in FIG. 6), a locking element in the form of a bolt protrusion 128 and a bolt spring 132 engaged between the bolt protrusion 128 and the coupling protrusion 116, an unlocking element in the form of an unlocking bolt surface 136, and a deadlocking feature in the form of a bolt shoulder 140. A bolt bumper 142 extends from the bolt shoulder 140. The bolt spring 132 biases the bolt 56 away from the coupling element 80. The bolt shoulder 140 defines a sloped or angled profile on a first side and a straight profile on a second side, but in other constructions may define a straight or normal profile, a curved profile, or another profile, on either side as desired. In other constructions, the bolt axis B is arranged obliquely relative to the actuator axis A, or substantially parallel to the actuator axis A. In some embodiments, the bolt spring 132 is arranged to bias the bolt 56 away from the coupling element 80 in locked position and to bias the bolt toward the coupling element 80 in an unlocked position.

A first bolt position sensor 134*a* is positioned near to (e.g., adjacent) the bolt 56 and in communication with the controller 44. The first bolt position sensor 134*a* provides signals to the controller 44 indicative of the position of the bolt 56. A first signal represents the bolt 56 is in the retracted bolt position, and a second signal indicates that the bolt 56 is in the extended bolt position. In one embodiment, the first bolt position sensor 134*a* is a beam-break sensor that includes an emitter and a receiver and the first signal is a first sensor broken beam signal indicating that the bolt 56 is in the retracted bolt position and the second signal is a first sensor connected beam signal indicating that the bolt 56 is in the extended bolt position.

A second bolt position sensor 134*b* is positioned near to (e.g., adjacent) the bolt 56 and in communication with the controller 44. The second bolt position sensor 134*b* provides signals to the controller 44 indicative of the position of the bolt 56. A first signal represents the bolt 56 is in the retracted bolt position, and a second signal indicates that the bolt 56 is in the extended bolt position. In one embodiment, the second bolt position sensor 134*b* is a beam-break sensor that includes an emitter and a receiver and the first signal is a second sensor connected beam signal indicating that the bolt 56 is in the retracted bolt position and the second signal is a second sensor broken beam signal indicating that the bolt 56 is in the extended bolt position.

The first bolt position sensor 134*a*, the second bolt position sensor 134*b*, and the rotational position sensor 106 work together with the controller 44 to determine the position of the cam head 76 and the bolt 56. In one embodiment, the rotational position sensor 106 determines the state of the cam head (e.g., unlocked position or locked position), and the first bolt position sensors 134*a* and the second bolt position sensor 134*b* together determine the position of the bolt (e.g., extended bolt position or retracted bolt position). In some embodiments, if the rotational position sensor 106 indicates that the cam head 76 is in a wrong position (e.g., instructed to be in the unlocked position, but the sensor 106 indicated the cam head is in the locked position), the controller 44 is able to determine that there is a problem with the actuator (e.g., the motor 72 and the cam head 76) and provide a fault code that may be displayed or otherwise communicated to the user. In some embodiments, if the rotational position sensor 106 indicates that the cam head 76 is in the proper position, but the first bolt position sensor 134*a* and/or the second bolt position sensor 134*b* indicates that the position of the bolt 56 does not correspond to the position of the cam head 76, then the controller 44 recognizes a jam and provides a fault code that may be displayed or otherwise communicated to the user. In other words, in some embodiments, if the controller 44 and the rotational position sensor 106 disagree on the position of the cam head, the system indicates a problem with the actuator, and if the rotational position sensor 16 and the first and second bolt position sensors 134*a/b* disagree on the position of the bolt 56, the system indicates a jam. In some embodiments, an intermediate jam may occur and the first bolt position sensor 134*a* disagrees with the second bolt position sensor 134*b*. This may indicate that the bolt 56 is jammed between the extended and the retracted bolt positions.

In the illustrated embodiment, the sensors 106, 134*a*, 134*b* are beam-break sensors that include an emitter and a receiver. In other embodiments, the sensors include Hall sensors, optical sensors, microswitches, or other sensor types, as desired. In some embodiments, one or more of the sensors 106, 134*a*, 134*b* is mounted on the PCB-A that includes the controller 44. In some embodiments, one or more of the sensors 106, 134*a*, 134*b* are located remote from the PCB-A and may communicate with the controller 44 via I/O ports, μC inputs, wireless communication, or be directly wired to the PCB-A or the controller 44.

The deadlocking lever 84 is rotatably mounted to the body 48 at a deadlock axis C that is arranged perpendicular to both the actuator axis A and the bolt axis B, and includes a deadlock cam follower in the form of deadlock surface 144 arranged to interact with the deadlock cam profile of the cam head 76 and specifically with the third protrusion 104 and the fourth protrusion, a deadlock biasing element in the form of a deadlock shaft 146 a deadlock spring 148 that biases the deadlocking lever 84 toward the bolt 56, and a deadlocking feature in the form of a lever shoulder 152 arranged to interact with the bolt shoulder 140 of the bolt 56. The lever shoulder 152 defines a sloped or angled profile on a first side and a straight profile on a second side, but in other constructions may define a straight or normal profile, a curved profile, or another profile, on either side as desired.

In operation and with reference to FIG. 4, the lock 24 is actuatable between the locked position and the unlocked position. The lock 24 is shown in the unlocked position in FIG. 4, with the motor 72 positioning the cam head 76 in an unlocked cam position, and the coupling spring 120 biasing the coupling element 80 toward the retracted coupling position so that the unlocking coupling surface 112 of the coupling element 80 contacts the bolt shoulder 140, and the bolt bumper 142 contacts the motor mount 86. When the coupling element 80 is in the retracted position, a gap is maintained between the following shoulder 108 and the bolting cam profile (e.g., the first protrusion 96). The transference of loads from the motor mount 86 to the unlocking coupling surface 112, and the resultant gap, reduces impact forces on the motor 72 and other actuating components due to impacts and locking unlocking cycles, and prolongs the life of the lock 24. The unlocking coupling surface 112 also contacts the unlocking bolt surface 136 so that the bolt 56 is biased toward the retracted bolt position by the coupling spring 120.

Figure 5:
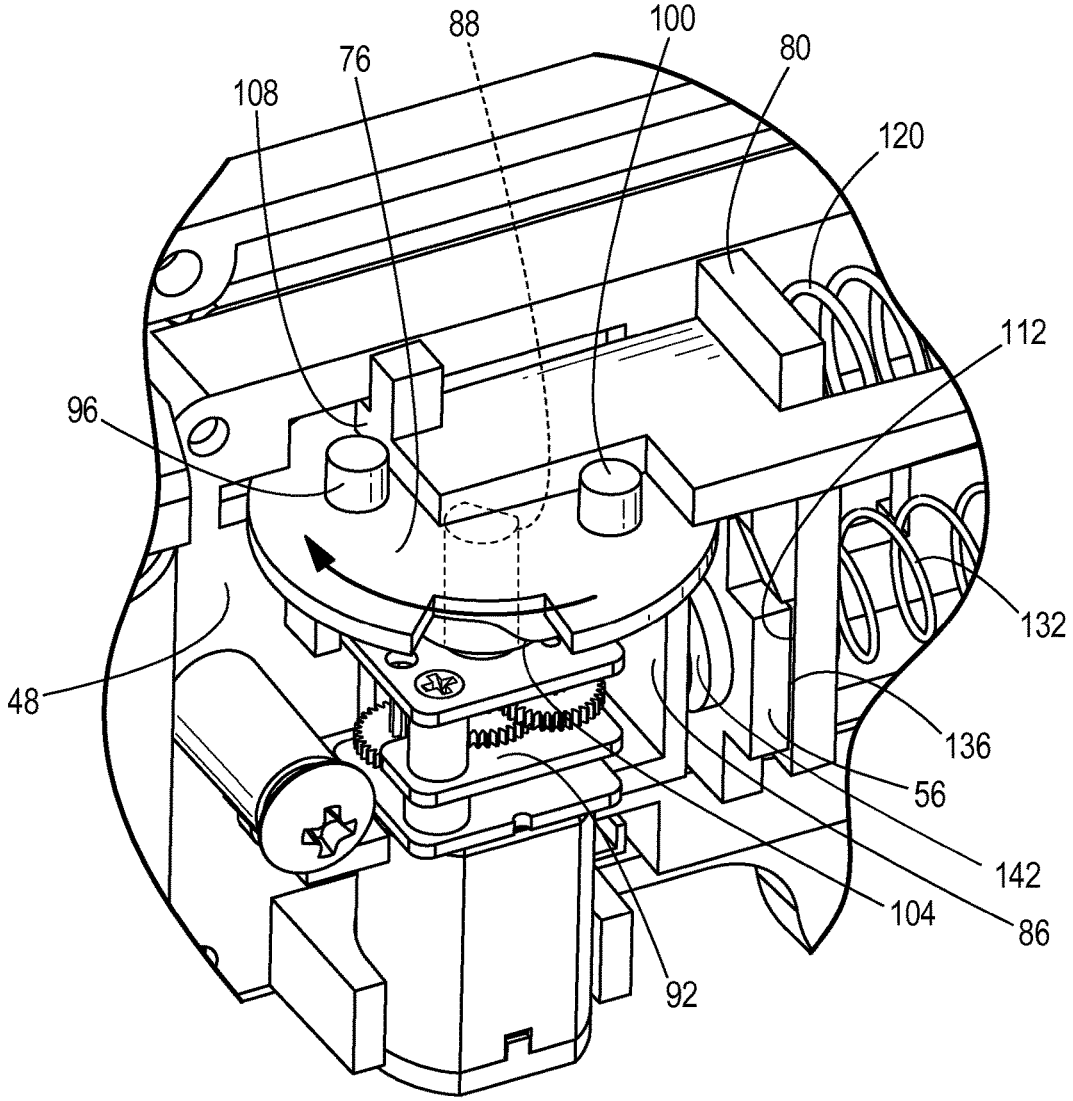
FIG. 5 is a pictorial detail view of an actuator of the latching assembly of FIG. 3 in the unlocked position.

FIG. 5 shows the gap between the first protrusion 96 and the following shoulder 108 before the coupling element 80 is urged toward the extended coupling position as the motor 72 rotates the shaft 88 in response to power provided by the controller 44. Turning to FIG. 6, the lock 24 is shown in the locked position. The first protrusion 96 has urged the coupling element 80 into the extended coupling position against the bias of the coupling spring 120. In turn, the bolt spring 132 biases the bolt 56 toward the bolt extended position such that the latching portion 124 extends beyond the bolt aperture 60.

As also shown in FIG. 6, the deadlocking lever 84 is arranged such that the bolt 56 is inhibited from returning to the retracted bolt position by the relative positions of the bolt shoulder 140 and the lever shoulder 152. As the cam head 76 moves from the locked cam position to the unlocked cam position, the third protrusion 104 urges the deadlock shaft 146 downward (as shown in FIG. 6) against the bias of the deadlocking spring 148, so that the deadlocking lever 84 is rotated downward and the bolt 56 may pass by the lever shoulder 152 uninhibited (see FIG. 8). The sloped shaped of the lever shoulder 152 and the bolt shoulder 140 also aid in the movement of the bolt 56 past the deadlocking lever 84. In other constructions, the third protrusion 104 does not urge the deadlocking lever 84 downward as the cam head 76 moves from the unlocked cam position to the locked cam position, and the sloped shape of the lever shoulder 152 and the bolt shoulder 140 alone allows the bolt 56 to move past the deadlocking lever 84. In either case, when the bolt 56 has cleared the lever shoulder 152, the deadlocking spring 148 biases the deadlocking lever 84 upward so that the lever shoulder 152 inhibits the bolt 56 from returning to the retracted bolt position.

Figure 7:
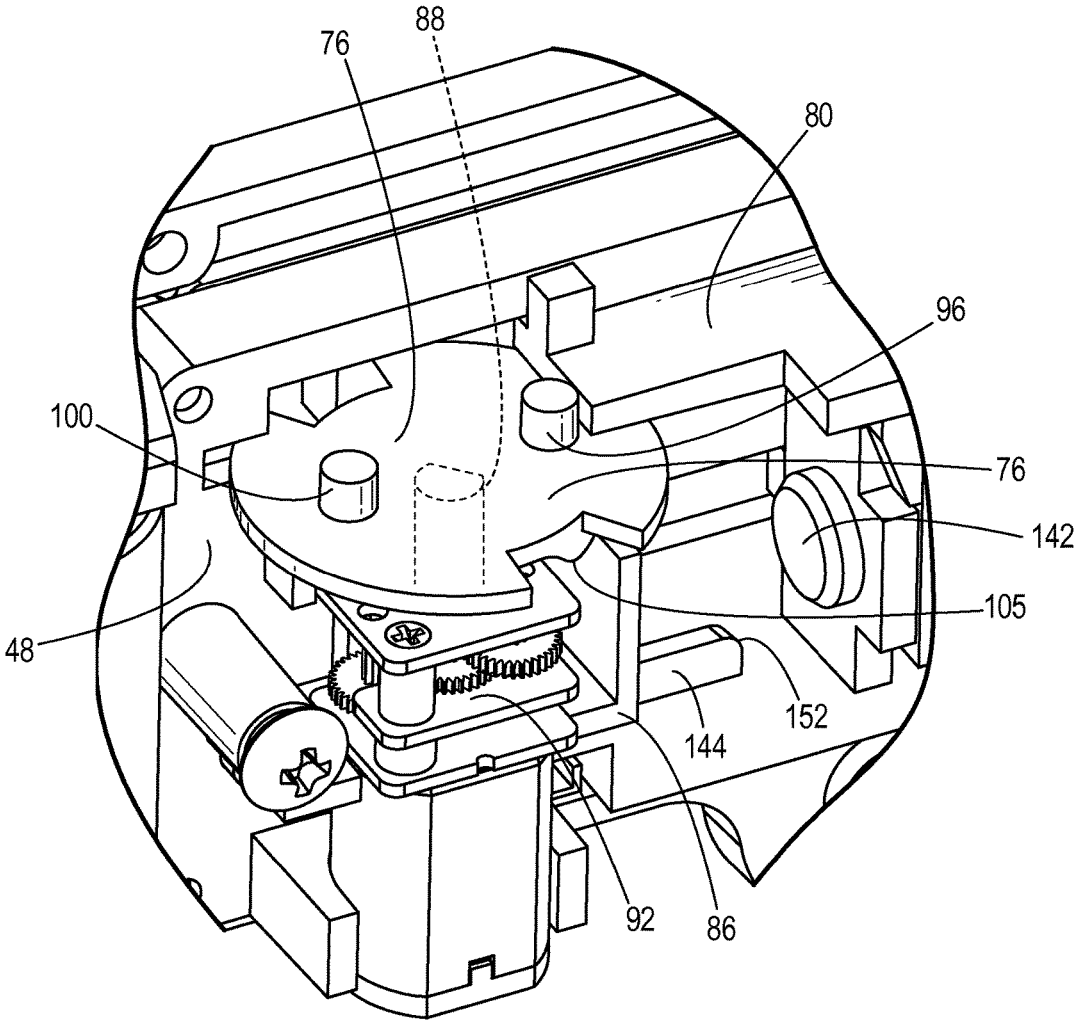
FIG. 7 is a pictorial detail view of the actuator of the latching assembly of FIG. 3 in the locked position.

As shown in FIG. 7, when the lock 24 is arranged in the locked position, the cam head 76 is arranged in the locked cam position with the first protrusion 96 engaged with the following shoulder 108 to urge the coupling element 80 into the extended coupling position.

Continued rotation of the cam head 76 results in the first protrusion 96 passing by the following shoulder 108 and the coupling spring 120 biasing the coupling element 80 toward the retracted coupling position until the further retraction is inhibited by contact between the unlocking coupling surface 112 of the coupling element 80, the bolt shoulder 140, the bolt bumper 142, and the motor mount 86. Also, during the rotation of the cam head 76, the fourth protrusion 105 moves the deadlocking lever 84 via the deadlock shaft 146 so that the deadlocking lever 84 does not inhibit the return of the bolt 56 to the retracted bolt position. The unlocking coupling surface 112 engages a portion of the bumper 142 and the bolt 56 is urged back toward the retracted bolt position (as shown in FIG. 4). In other embodiments, the unlocking coupling surface 112 may engage the unlocking bolt surface 136. The bumper 142 can be arranged to provide a sound and shock damping effect when contacting the unlocking coupling surface 112 and/or the motor mount 86.

Figure 8:
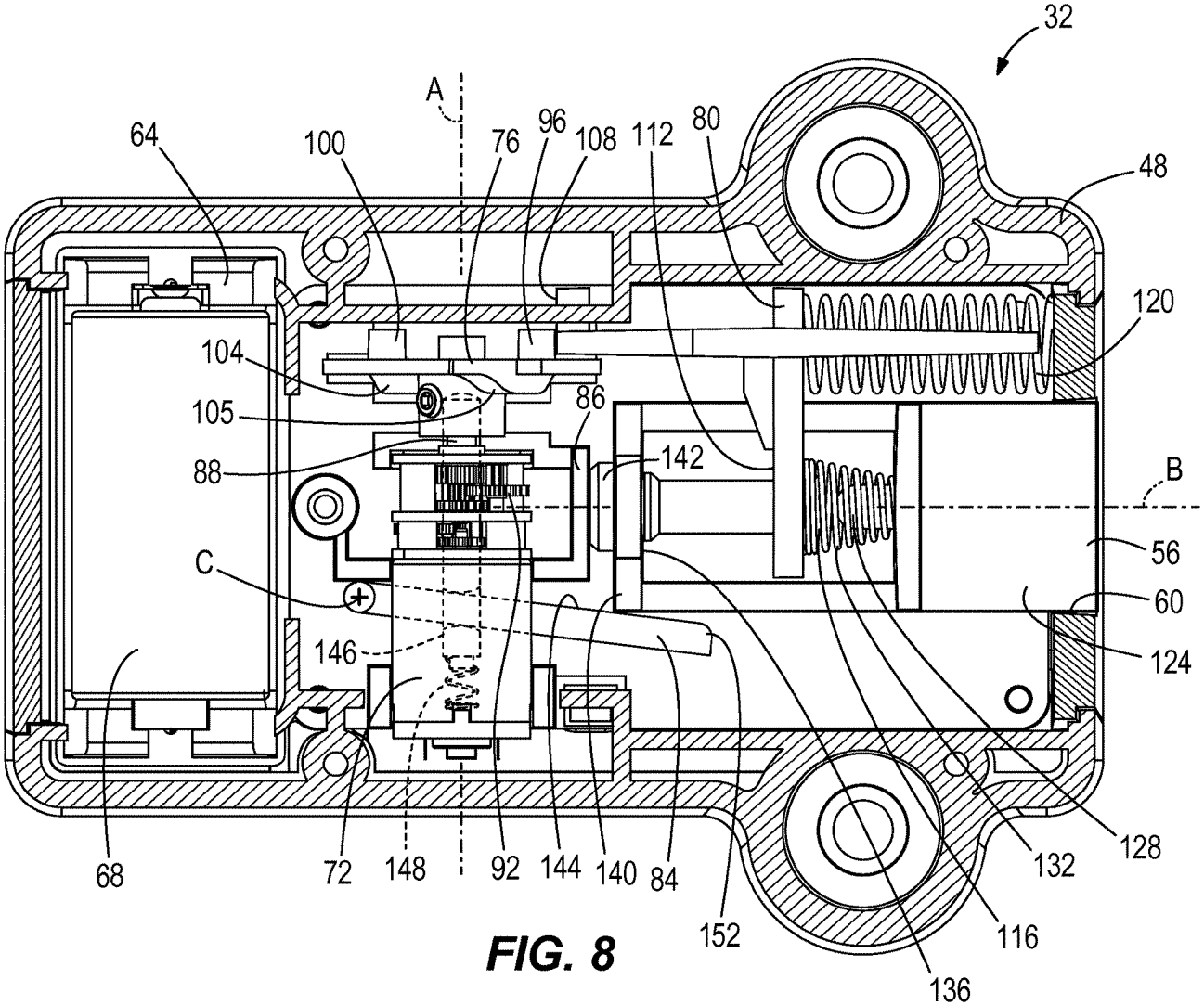
FIG. 8 is a section view of the latching assembly taken along line 4-4 of FIG. 3 showing the latching assembly arranged in a first jam condition.

As shown in FIG. 8, a first jam condition can occur when the bolt 56 is inhibited (e.g., by an obstruction, a blockage, or a jam) from moving to the extended bolt position. In the first jam condition, the cam head 76 is arranged in the locked cam position with the first protrusion 96 urging the coupling element 80 into the extended coupling position against the bias of the coupling spring 120. However, the bolt 56 is obstructed and so the bolt 56 cannot move into the extended bolt position. The bolt spring 132 is compressed between the coupling element 80 and the bolt 56 such that the bolt spring 132 biases the bolt 56 toward the extended bolt position. In this way, once the obstruction is removed the bolt 56 will be actuated to the extended bolt position by the bias of the bolt spring 132 resulting in the lock being arranged in the lock position. Additionally, the deadlocking lever 84 is biased upward by the deadlock spring 148. Once the bolt moves into the extended bolt position, the deadlocking lever 84 is moved upward to inhibit movement of the bolt 56 to the retracted bolt position.

Figure 9:
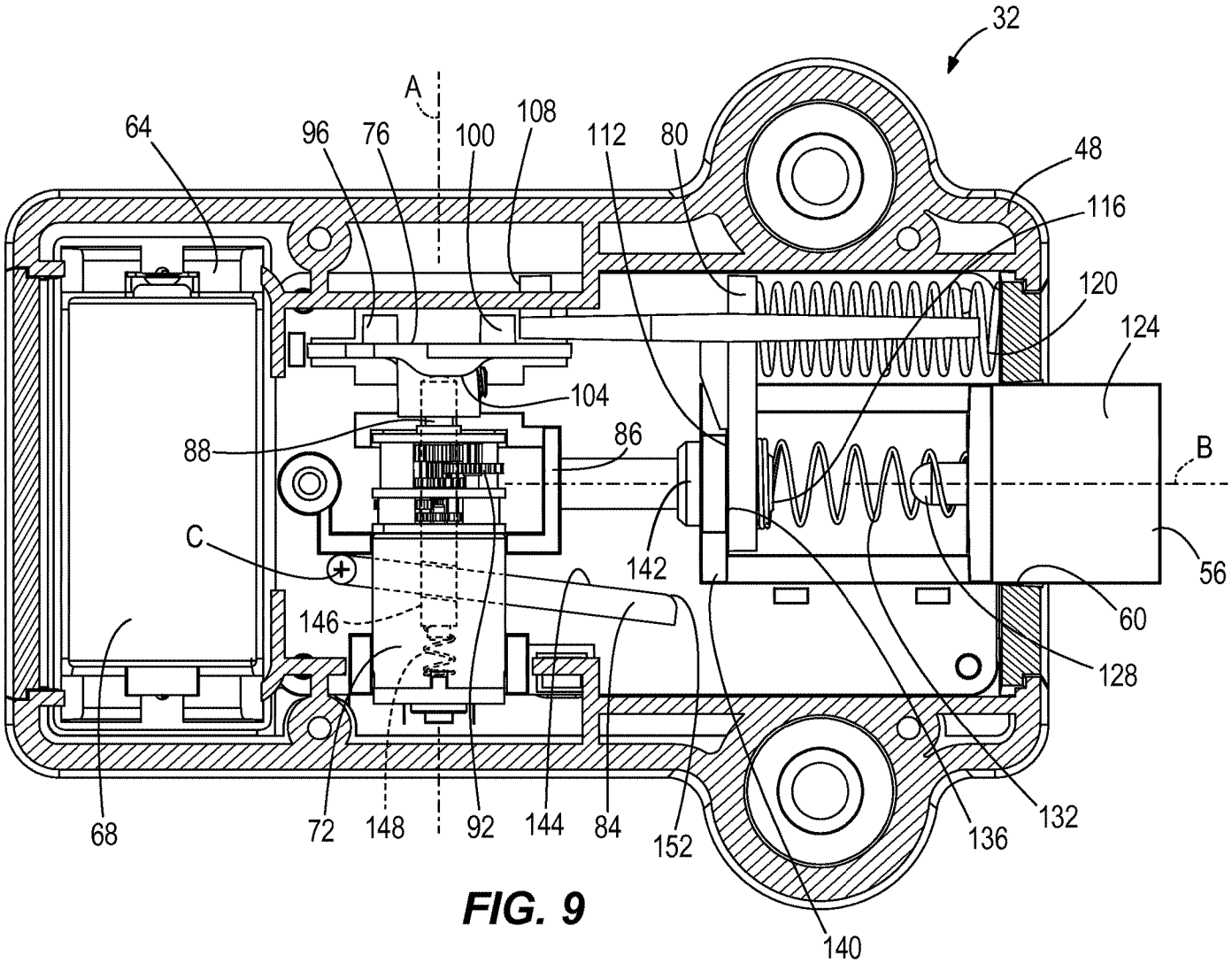
FIG. 9 is a section view of the latching assembly taken along line 4-4 of FIG. 3 showing the latching assembly arranged in a second jam condition.
Figure 10:
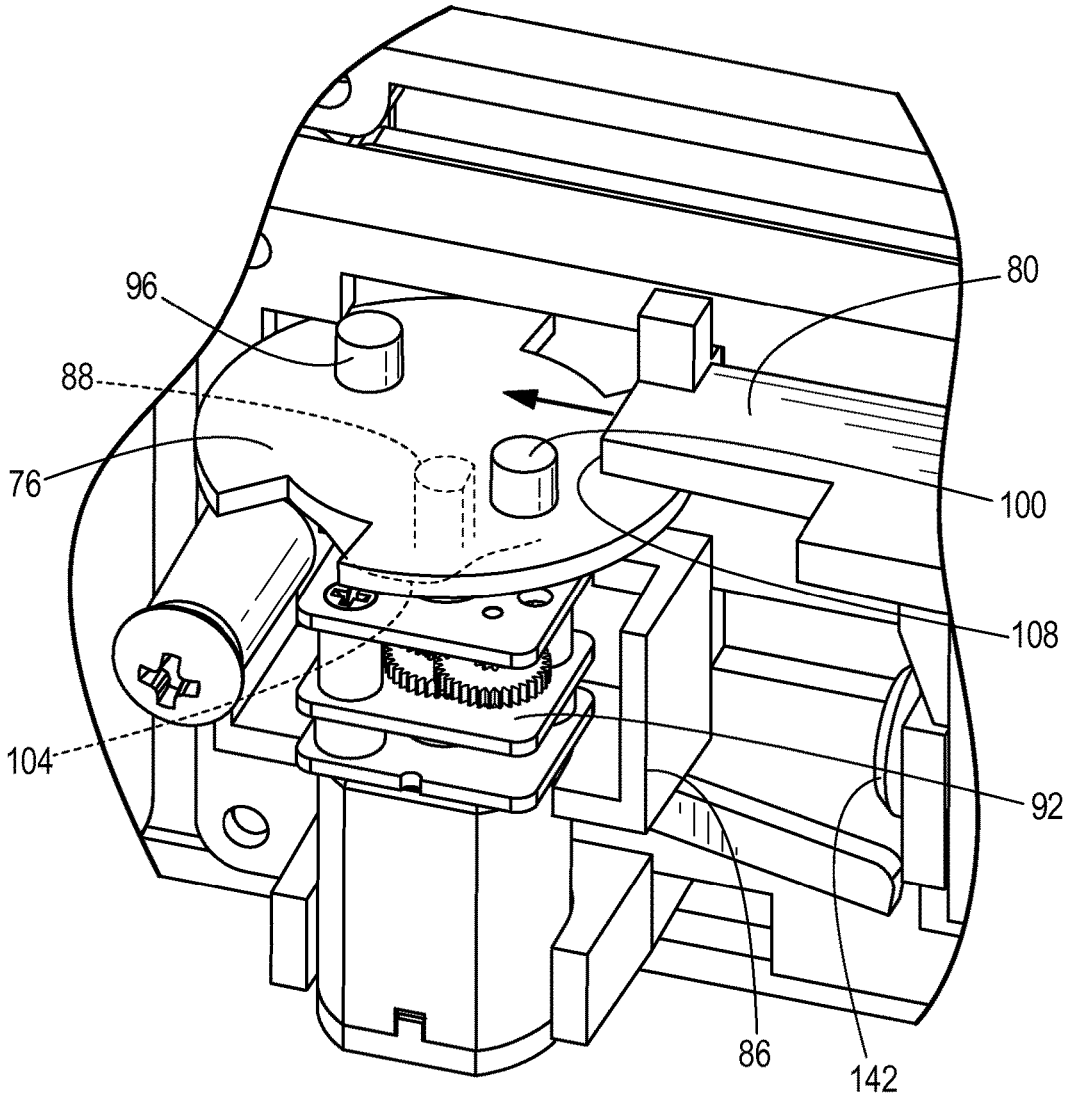
FIG. 10 is a pictorial detail view of the lock actuator of the latching assembly of FIG. 9.

As shown in FIG. 9, a second jam condition can occur when the bolt 56 is inhibited (e.g., by an obstruction, a blockage, or a jamming) from returning to the retracted bolt position. The second jam condition, the cam head 76 is arranged in the unlocked cam position so that the deadlocking lever 84 is urged by the fourth protrusion 105 into a lowered position that does not inhibit the bolt 56 from returning to the retracted bolt position. Due to the inability of the bolt 56 to return to the retracted bolt position, the bumper 142 (or alternatively the unlocking bolt surface 136) engages the unlocking coupling surface 112 and inhibits the coupling element 80 from returning to the retracted coupling position. The coupling spring 120 is biasing the coupling element 80 toward the retracted coupling position in the second jam condition so that when the obstruction is removed, the coupling spring 120 will urge the coupling element 80 toward the retracted coupling position, resulting in the movement of the bolt 56 to the retracted bolt position. FIG. 10 shows the relative positions of the cam head 76 and the coupling element 80 when arranged in the second jam condition.

It should be noted that in the above descriptions the first protrusion 96 and the second protrusion 100 can be substituted for one another, and the third protrusion 104 and the fourth protrusion 105 can be substituted for one another. Because the shaft 88 is arranged to rotate in one direction, each of the first protrusion 96 and the second protrusion 100, and the third protrusion 104 and the fourth protrusion 105 perform each operation required of the cam head 76 in alternating cycles.

One benefit provided by the lock 24 is that the first and second jam conditions do not damage any internal components of the lock 24. Because the coupling element 80 can always move and outside forces are inhibited from binding the coupling element 80, the motor 72 is always free to turn and is inhibited from experiencing a stall condition. Another advantage is that the lock 24 returns to normal operation immediately after an obstruction or jam is cleared and/or removed.

In an alternative construction, the deadlocking lever 84 may be eliminated and the latching portion 124 of the bolt 56 defines a ramped surface on one side. In such a construction, the lock 24 can provide a push to lock feature wherein a user simply pushes the door 20 into the closed position, and the bolt 56 is capable of moving into the retracted bolt position against the bias of the bolt spring 132 (similar to the arrangement shown in FIG. 8) until the door 20 is closed and the bias of the bolt spring 132 moves the bolt 56 into the extended bolt position and the lock 24 is arranged in the locked position (as shown in FIG. 6).

Figures 11, 12:
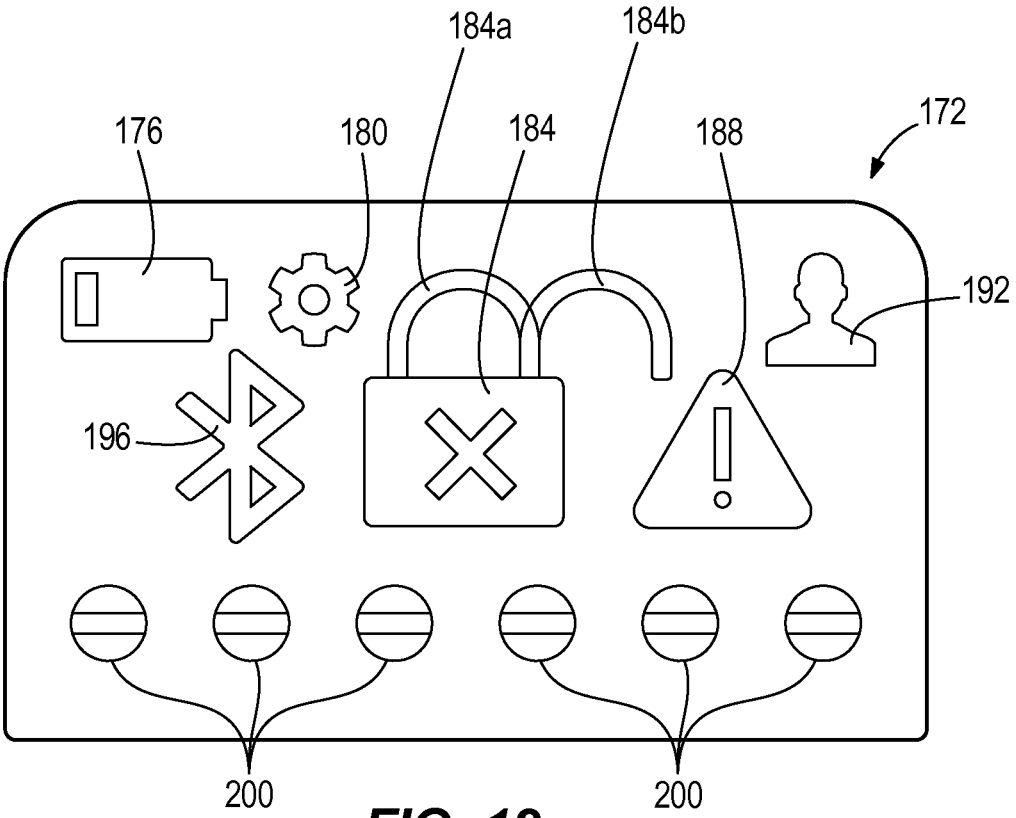
FIG. 11 is a chart of latching assembly states according to one construction.
FIG. 12 is a schematic view of a display of the interface assembly of FIG. 2 according to one construction.

As shown in FIG. 11, the display 40 is arranged to display one of four icons at any given time to inform the user of the lock status. The controller 44 communicates with the rotational position sensor 106 and the bolt position sensor 134 to determine the status of the lock 24. If the controller 44 determines that the cam head 76 is in the unlocked cam position and the bolt 56 is in the bolt retracted position, the controller 44 instructs the display 40 to show an unlocked icon 156. If the controller 44 determines that the cam head 76 is in the unlocked cam position and the bolt 56 is not in the bolt retracted position, the controller 44 instructs the display 40 to show a retraction prevented error icon 160. If the controller 44 determines that the cam head 76 is in the locked cam position and the bolt 56 is not in the bolt extended position, the controller 44 instructs the display 40 to show an extension prevented error icon 164. If the controller 44 determines that the cam head 76 is in the locked cam position and the bolt 56 is in the bolt extended position, the controller 44 instructs the display 40 to show a locked icon 168. It should be understood that the particular display elements shown in FIG. 11 are for the purposes of illustration only and, in other implementations, the functionality described here with respect to the controller 44, rotational position sensor 106, bolt position sensor 134, and other elements could be used in conjunction with other types of displays and/or display interfaces.

Figure 13:
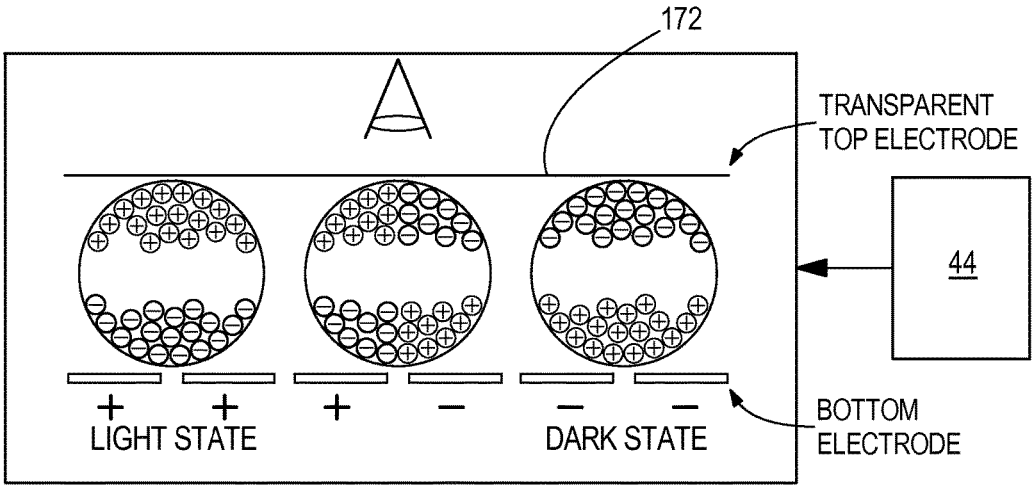
FIG. 13 is a schematic view of an internal arrangement of the display of FIG. 12.

In another construction shown in FIG. 12, the display 40 is replaced with a display 172 that includes a battery indicator 176, a settings indicator 180, a locked/unlocked indicator 184, an error indicator 188, a single user indicator 192, a Bluetooth® indicator 196, and a status indicator 200. The battery indicator 176 is structured so that the user is alerted when the batteries 68 are running low and need to be replaced. The settings indicator 180 is structured to indicate when the user is adjusting or changing settings of the lock 24. The locked/unlocked indicator 184 is structured to alert the user of the position of the lock 24 (i.e., the locked position or the unlocked position) and the vacancy of the locker. When the locker is occupied and the lock 24 is arranged in the locked position, a locked icon 184*a* is shown in white on a black background. When the locker is unlocked and the lock 24 is in the unlocked position, an unlocked icon 184*b* is shown in black on a white background. In other embodiments, different color combinations are contemplated. The error indicator 188 is structured to alert the user if the lock 24 is experiencing the first jam condition or the second jam condition. The single user indicator 192 is structured to indicate that the lock 24 is set to a single user mode, where the lock 24 is set to only work for one code and one user. In the single user mode, the code is not required to lock the lock 24, only to unlock the lock 24. The Bluetooth® indicator 196 alerts the user if a Bluetooth® enabled device is communicating with the lock 24. The status indicator 200 can be used to indicate a number of alerts or information. For example, the status indicator 200 may indicate how many digits are included in a password/passcode. As shown in FIG. 13, the display 172 may be controlled by the controller 44 and may operate using electrophoretics. In one example, the electrophoretics are E-ink brand. In some embodiments, the devices may be paired, (e.g., according to a Bluetooth pairing protocol), and in other embodiments the devices may communicate without pairing.

Figure 14:
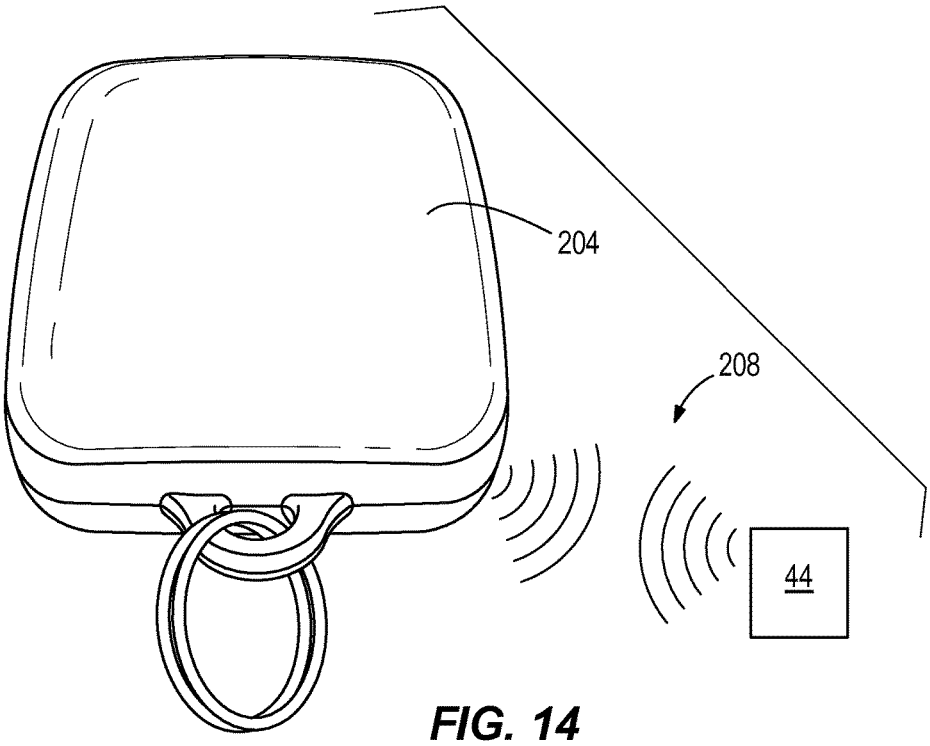
FIG. 14 is a pictorial view of a fob arranged to be used with the lock of FIG. 1 according to one construction.

As shown in FIG. 14, a keyfob 204 may be used to move the lock 24 to the unlocked position. The illustrated keyfob 204 operates via Bluetooth® communication 208 with the controller 44. In other constructions, the keyfob 204 may operate using wifi, RFID, or another wireless technology or protocol.

Figure 15:
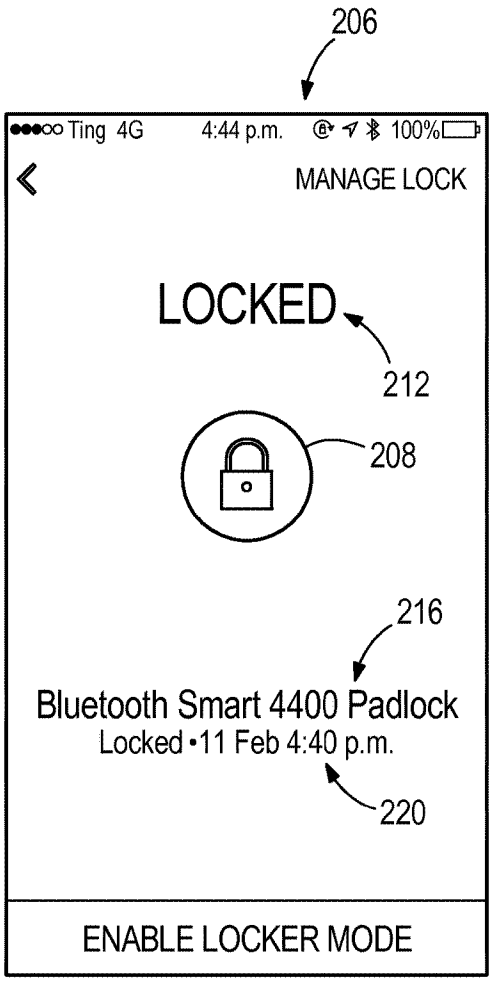
FIG. 15 is a screenshot of a mobile device display arranged to interact with the lock of FIG. 1 according to one construction.
Figure 16:
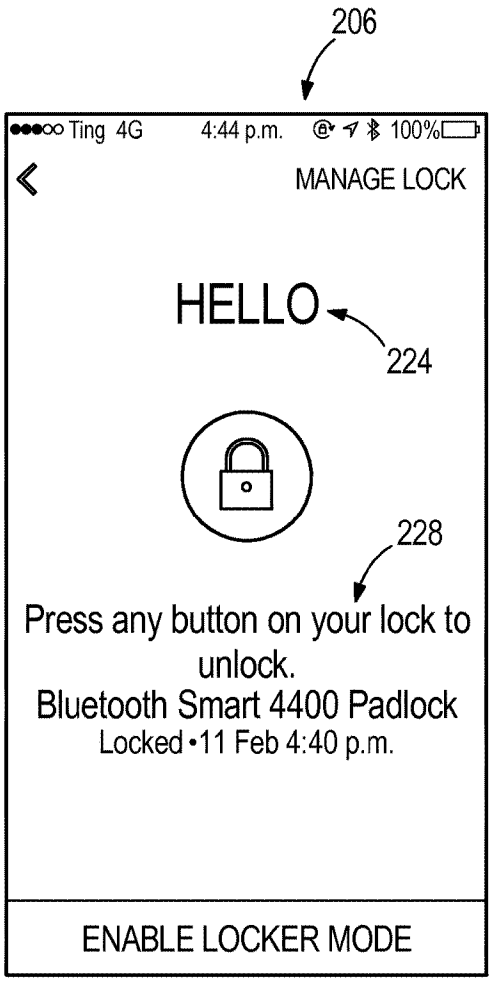
FIG. 16 is another screenshot of the mobile device display of FIG. 15.
Figure 17:
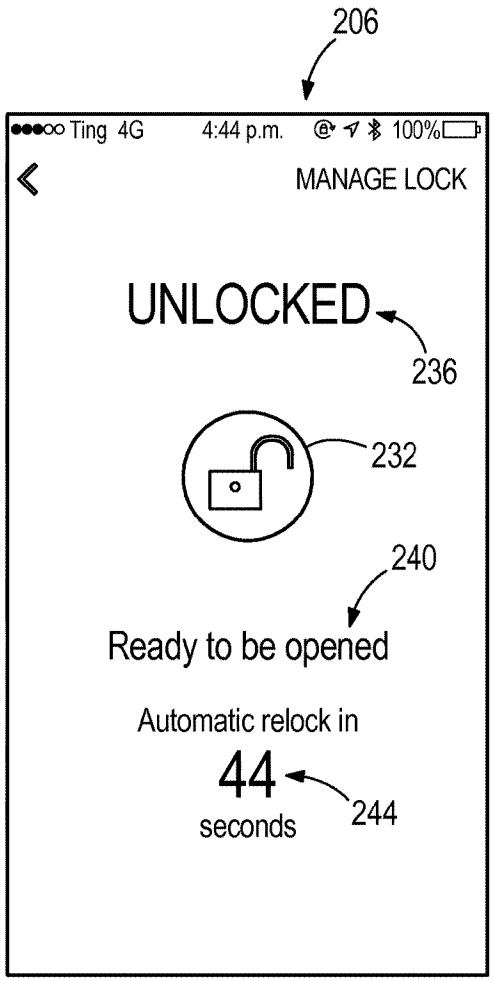
FIG. 17 is another screenshot of the mobile device display of FIG. 15.

As shown in FIGS. 15-17, the mobile device (e.g., a smartphone) can communicate via a wireless connection with the lock 24. The user may choose to install a locker application or may interact with the locker in a different way. As shown in FIG. 15, when the lock 24 is arranged in the locked position, the user may see a screen 206 including a locked icon 208 and text 212 indicating the lock 24 is in the locked position. The screen 206 may also include text or a code 216 identifying which locker the user is interacting with. A text or code 220 may indicate when the last time the lock 24 was moved into the locked position.

As shown in FIG. 16, the screen 206 may display a greeting 224 when the user first accesses the lock 24. Text or icons 228 may indicate directions for how to use the lock 24. As shown in FIG. 17, the screen 206 may display an unlocked icon 232 and unlocked text 236 when the lock 24 is in the unlocked position. Additionally, the screen 206 may display an instruction 240 and a time remaining 244 before the lock 24 moves back into the locked position.

Figure 18:
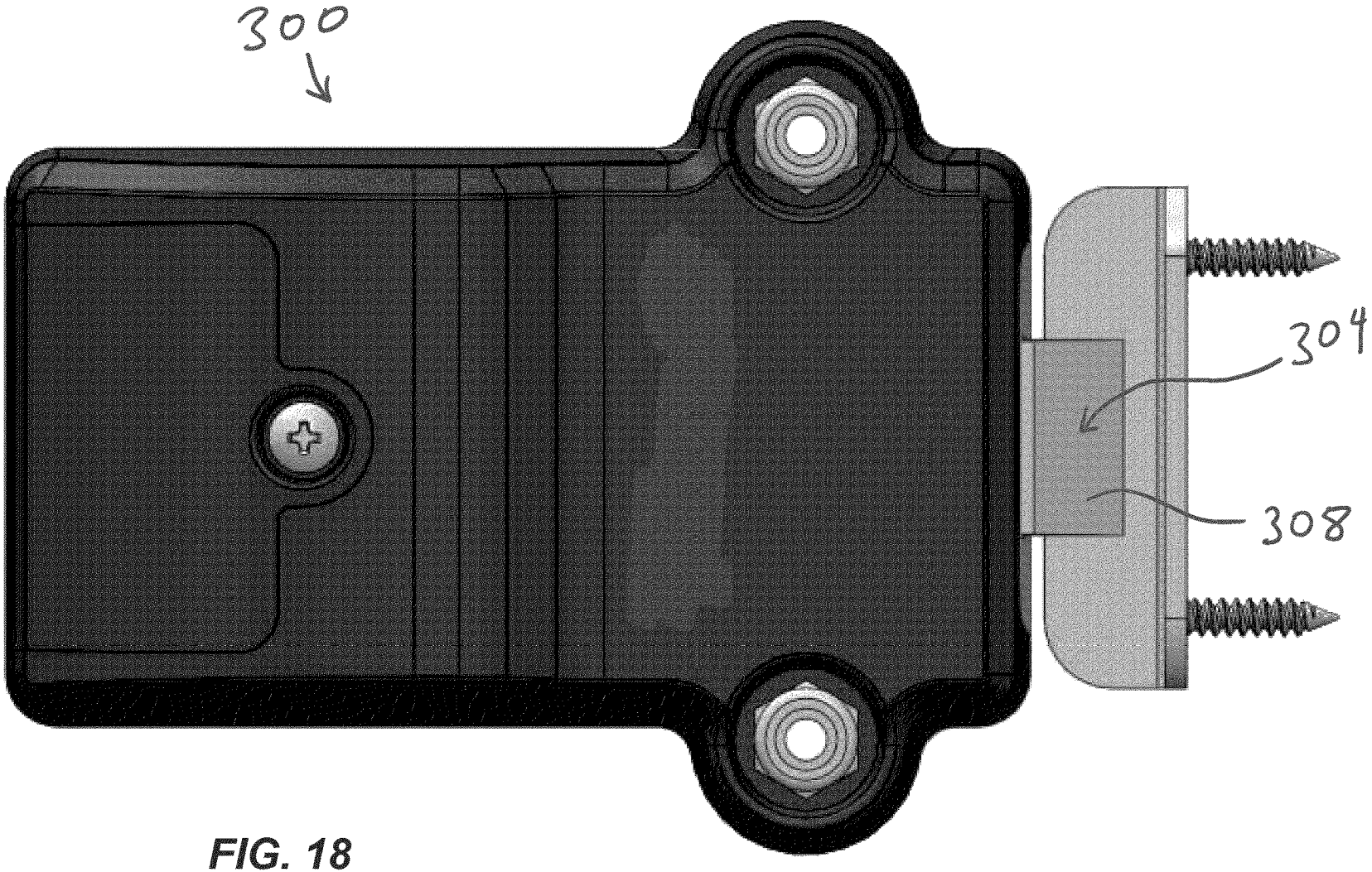
FIG. 18 is a front view of a push to close lock according to one construction.

As shown in FIG. 18, a push-to-close lock 300 is disclosed that includes a deadlocking feature. Details that differ between the push-to-close lock 300 and the lock 24 discussed above will be discussed with respect to FIGS. 18-38 below.

As shown in FIGS. 19*a* and 19*b*, a bolt 304 of the push-to-close lock 300 includes a deadbolt shaft slot 304*a*, an angled face 308, a spring holder 312, a bolt slot 316, and a bolt guide 322. The illustrated angled face 308 includes a forty degree (40°) angled face.

A body of the push-to-close lock 300 includes a face plate 324 (see FIG. 20) and a frame 328 (see FIG. 21). The faceplate 324 includes a bolt aperture 332 and a deadlock aperture 336. The frame 328 includes a deadbolt slot 340, a bolt slot 344 sized to receive the bolt guide 322, and a motor mount 348.

As shown in FIG. 22, a coupling element 352 includes a spring holder 356 and a bottom edge 360 that are shallower or moved up compared to the coupling element 80 discussed above. This shallower profile provides more space for other components.

Figure 23:
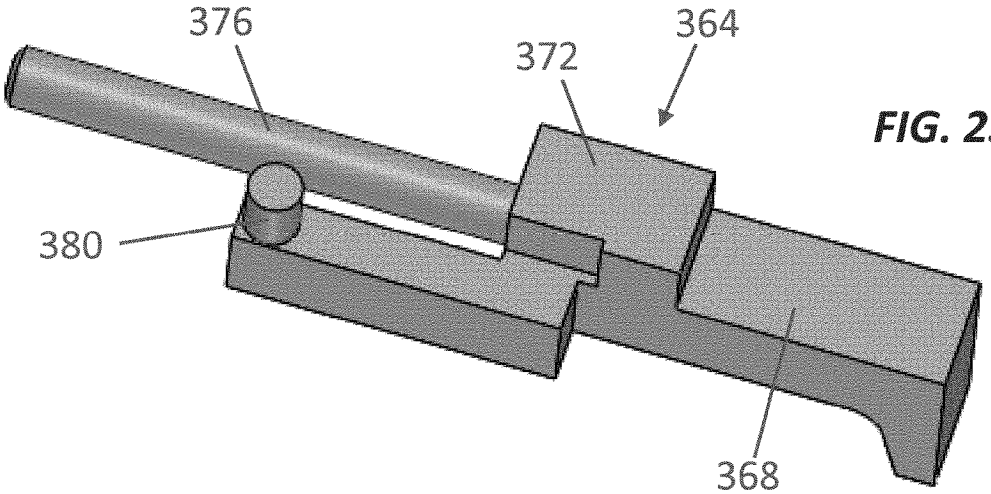
FIG. 23 is a pictorial view of a deadbolt of the push to close lock of FIG. 18 according to one construction.

As shown in FIG. 23, a deadbolt 364 includes a deadbolt shaft 368, a deadbolt shoulder 372, a deadbolt spring holder 376, and a deadbolt actuator in the form of a deadbolt cam follower 380. The deadbolt 364 is sized to be received within the deadbolt slot 340 of the frame 328.

Figure 25:
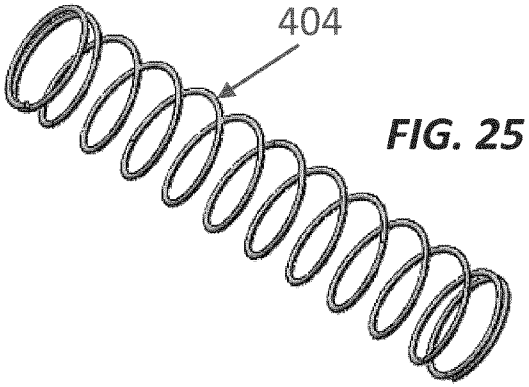
FIG. 25 is a pictorial view of a deadbolt spring of the push to close lock of FIG. 18 according to one construction.
Figure 24:
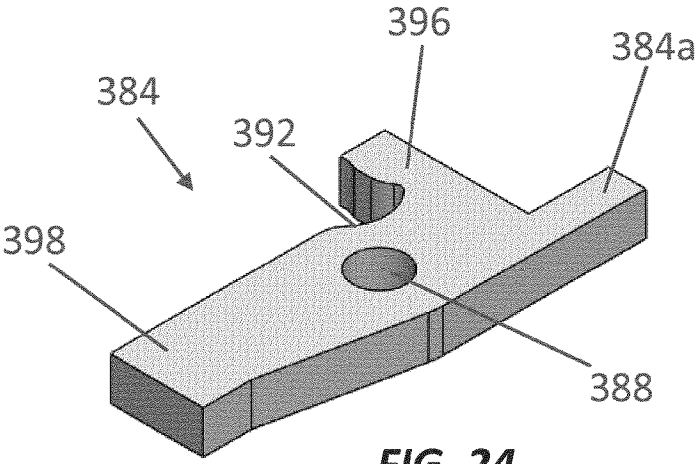
FIG. 24 is a pictorial view of a blocker arm of the push to close lock of FIG. 18 according to one construction.

As shown in FIG. 24, a deadbolt actuator in the form of a blocker arm 384 includes a blocking pivot in the form of a blocking aperture 388, a blocking cam 392, a first lever 396, a second lever 398, and a deadlock projection 384*a*. The blocking aperture 388 is sized to receive a pin formed on the bolt 304, so that the blocker arm 384 rotates relative to the bolt 304. The deadlock projection 384*a* limits the rotation of the blocker arm 384. A deadbolt spring 404 is shown in FIG. 25 and is sized to engage the deadbolt spring holder 376.

Figure 26:
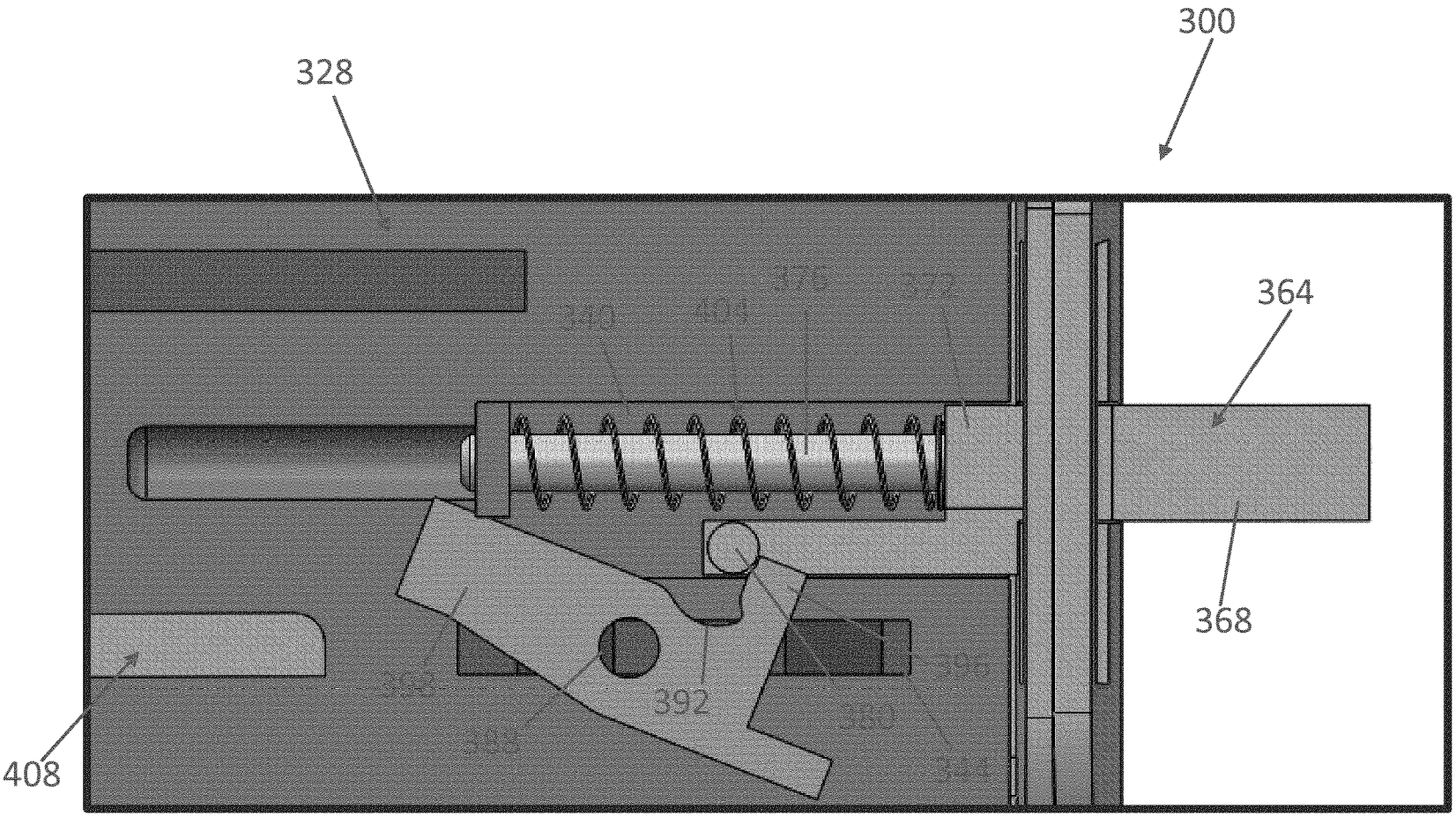
FIG. 26 is a sectional view of the push to close lock of FIG. 18 in a first arrangement according to one construction.

As shown in FIG. 26, the deadbolt spring 404, is coupled between the deadbolt slot 340 and the deadbolt spring holder 376 and biases the deadbolt 364 to an extended position. When the deadbolt shoulder 372 is engaged with the deadbolt shaft slot 304*a*, the blocker arm 384 is arranged in an unlocked position with the second lever 398 raised (as shown in FIG. 26). In other words, when the bolt 304 is even with the deadbolt 364, the blocker arm 384 is rotated into the unlocked position. In this position, a deadlocking lever 408 that operates similar to the deadlocking lever 84 discussed above does not engage with the blocker arm 384 and the bolt 304 is permitted to move into a retracted position.

Figure 27:
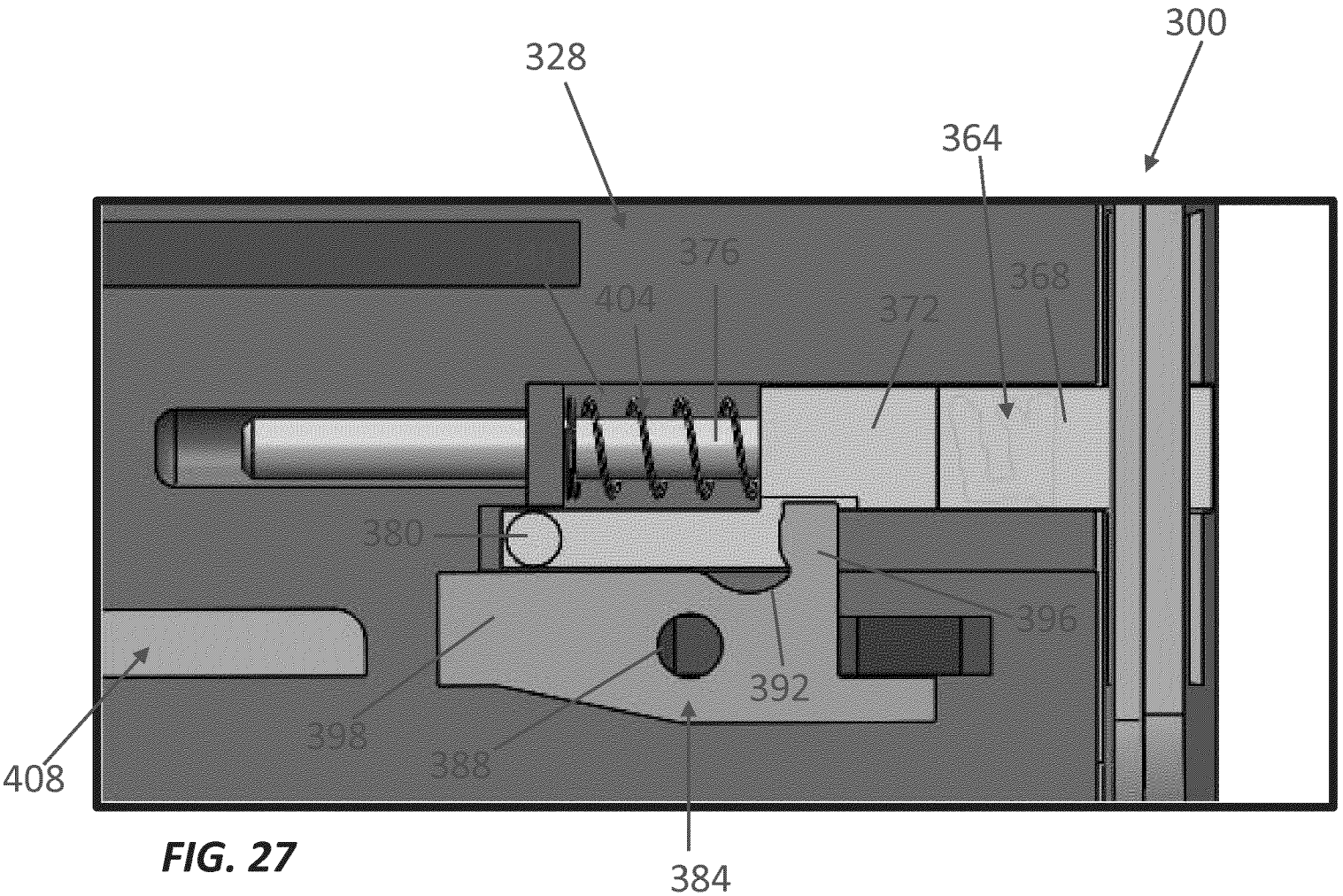
FIG. 27 is a sectional view of the push to close lock of FIG. 18 in a second arrangement according to one construction.

As shown in FIG. 27, the deadbolt shoulder 372 is disengaged from the bolt 304 such that the deadbolt cam follower 380 slides along the blocking cam 392 and onto the second lever 398. The blocker arm 384 is rotated to a deadlocked position and maintained in place by contact of the deadbolt cam follower 380 and the second lever 398. When in the deadlocked position, the deadlocking lever 408 is arranged to contact the blocker arm 384 and inhibit the bolt 304 from moving to a retracted position.

Figure 28:
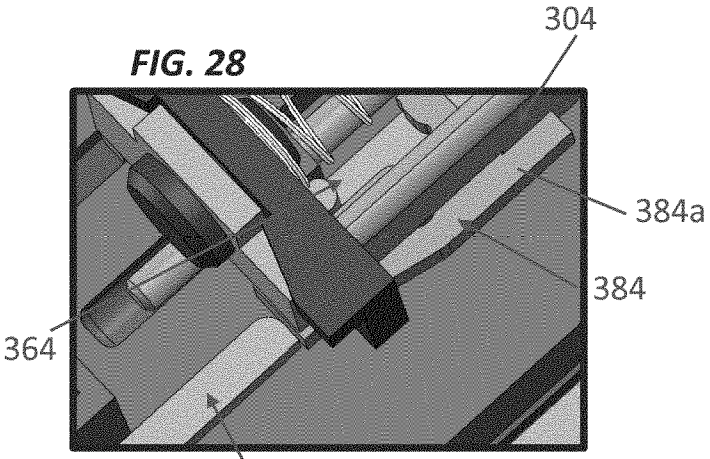
FIG. 28 is a pictorial view of the push to close lock of FIG. 18 in the second arrangement according to one construction.

FIG. 28 shows the blocker arm 384 arranged in the deadlocked position and in contact with the deadlocking lever 408. The blocker arm 384 is maintained in the deadlocked position by contact with the deadbolt cam follower 380 and with the deadlock projection 384*a*. When in the deadlocked position, the blocker arm 384 and the deadlocking lever 408 inhibit retraction of the bolt 304. In some embodiments, this position is called a shimming position.

Figure 29:
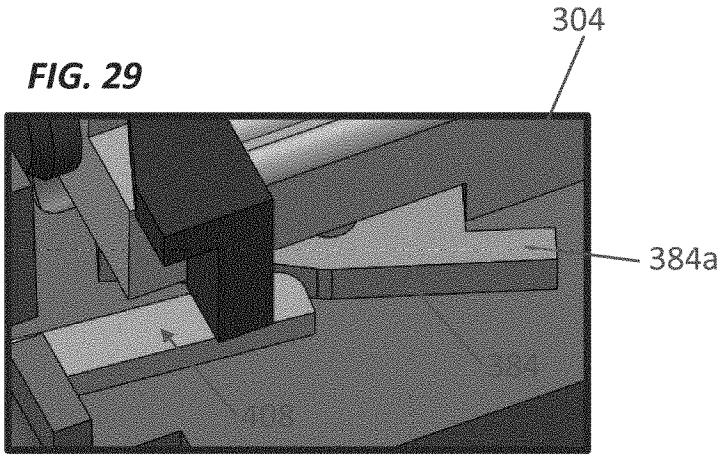
FIG. 29 is a sectional view of the push to close lock of FIG. 18 in the first arrangement according to one construction.

As shown in FIG. 29, when the lock 300 is arranged in a locked arrangement, and the user closes the door, the bolt 304 is moved toward the retracted position. As the bolt 304 moves toward the retracted position, the bolt 304 contacts the deadbolt shoulder 372 and the blocker arm 384 is moved into the unlocked position. As the bolt 304 continues to move into the retracted position, the angled face of the blocker arm 384 contracts the deadlocking lever 408 and moves the deadlocking lever 408 out of the way and the bolt 304 is permitted to move into the retracted position.

Figure 30:
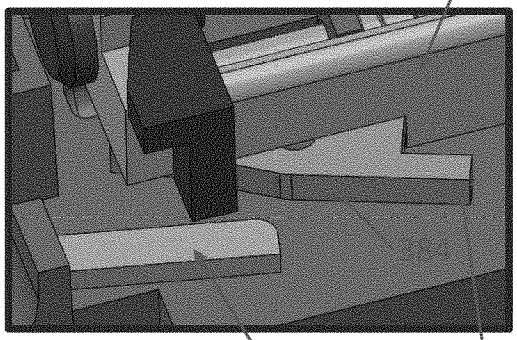
FIG. 30 is a sectional view of the push to close lock of FIG. 18 in a third arrangement according to one construction.

As shown in FIG. 30, the deadlocking lever 408 can be moved to an unlocked position so that the blocker arm 384 can pass by the deadlocking lever 408 and the bolt is permitted to move to the retracted position regardless of the position of the blocker arm 384.

Figure 31:
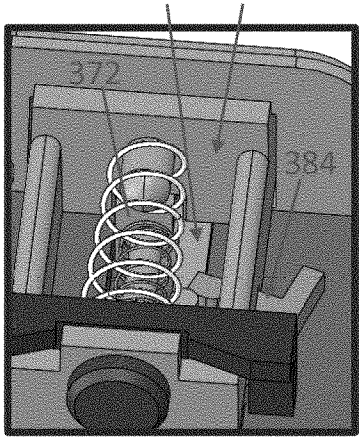
FIG. 31 is a sectional view of the push to close lock of FIG. 18 according to one construction.

FIG. 31 shows the bolt 304 engaged with the deadbolt shoulder 372 via the deadbolt shaft slot 304*a*. In the arrangement shown in FIG. 31, the blocker arm 384 is in the unlocked position.

Figure 32:
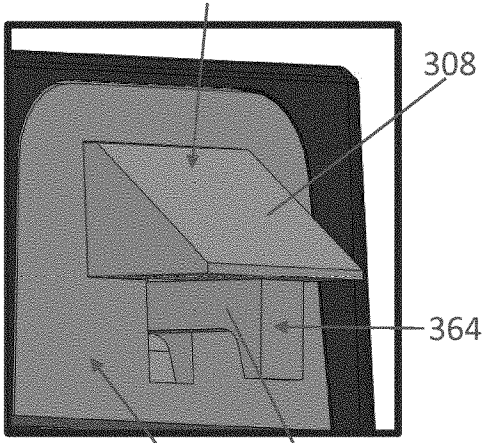
FIG. 32 is a pictorial view of the push to close lock of FIG. 18 according to one construction.

As shown in FIG. 32 the deadbolt 364 extends from the face plate 324 below (as shown in FIG. 32) the bolt 304. Below, operation of the deadlocking system of the lock 300 is described with respect to FIGS. 33-38. The general operation of the lock 32 discussed above also applies to the lock 300.

Figure 33:
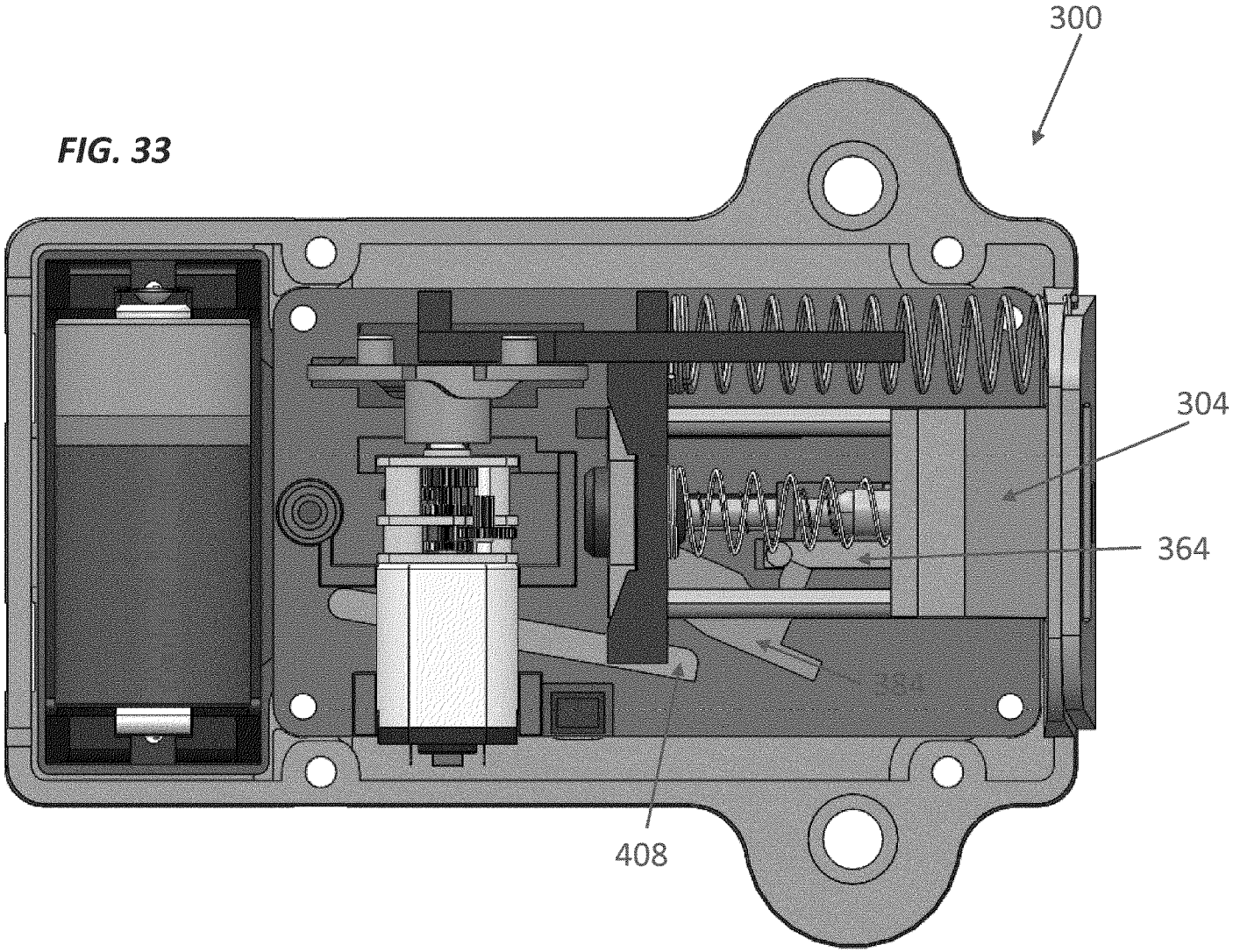
FIG. 33 is a sectional view of the push to close lock of FIG. 18 in an unlocked arrangement according to one construction.

As shown in FIG. 33, the lock 300 is in an unlocked arrangement. The bolt 304 is in the retracted position, and the bolt 304 moves the deadbolt 364 to the retracted position via contact with the deadbolt shoulder 372. In the unlocked arrangement, the deadlocking lever 408 is in the unlocked position so that the blocker arm 384 does not contact the deadlocking lever 408.

Figure 34:
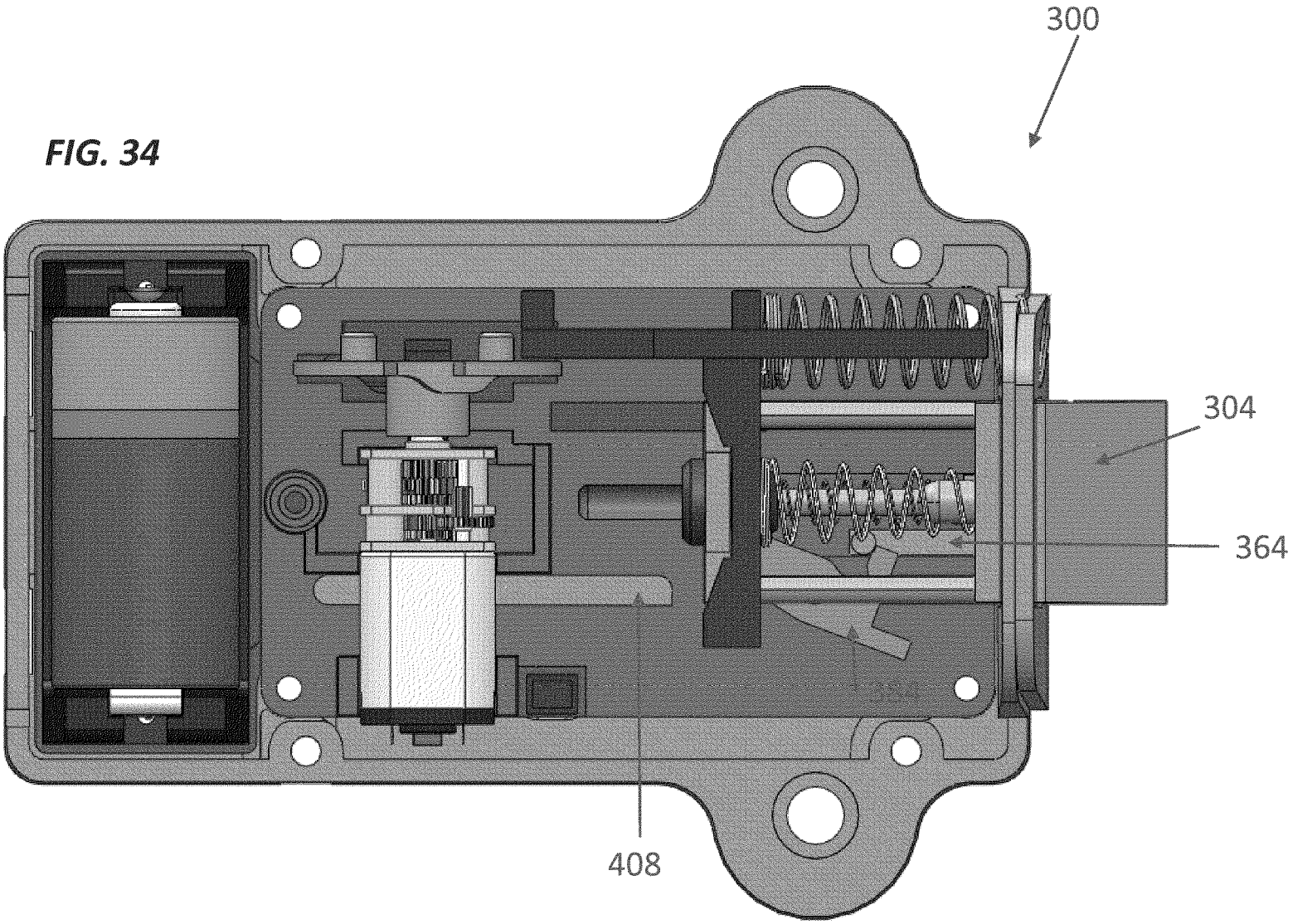
FIG. 34 is a sectional view of the push to close lock of FIG. 18 in a locked arrangement and the locker door open and ready to be closed according to one construction.

As shown in FIG. 34, the lock 300 is in the locked arrangement with a locker door open (for example). Here, the deadlocking lever 408 has moved into the deadlocked position, and the bolt 304 is extended. The deadbolt 364 is urged to the extended position by the deadbolt spring 404.

Figure 35:
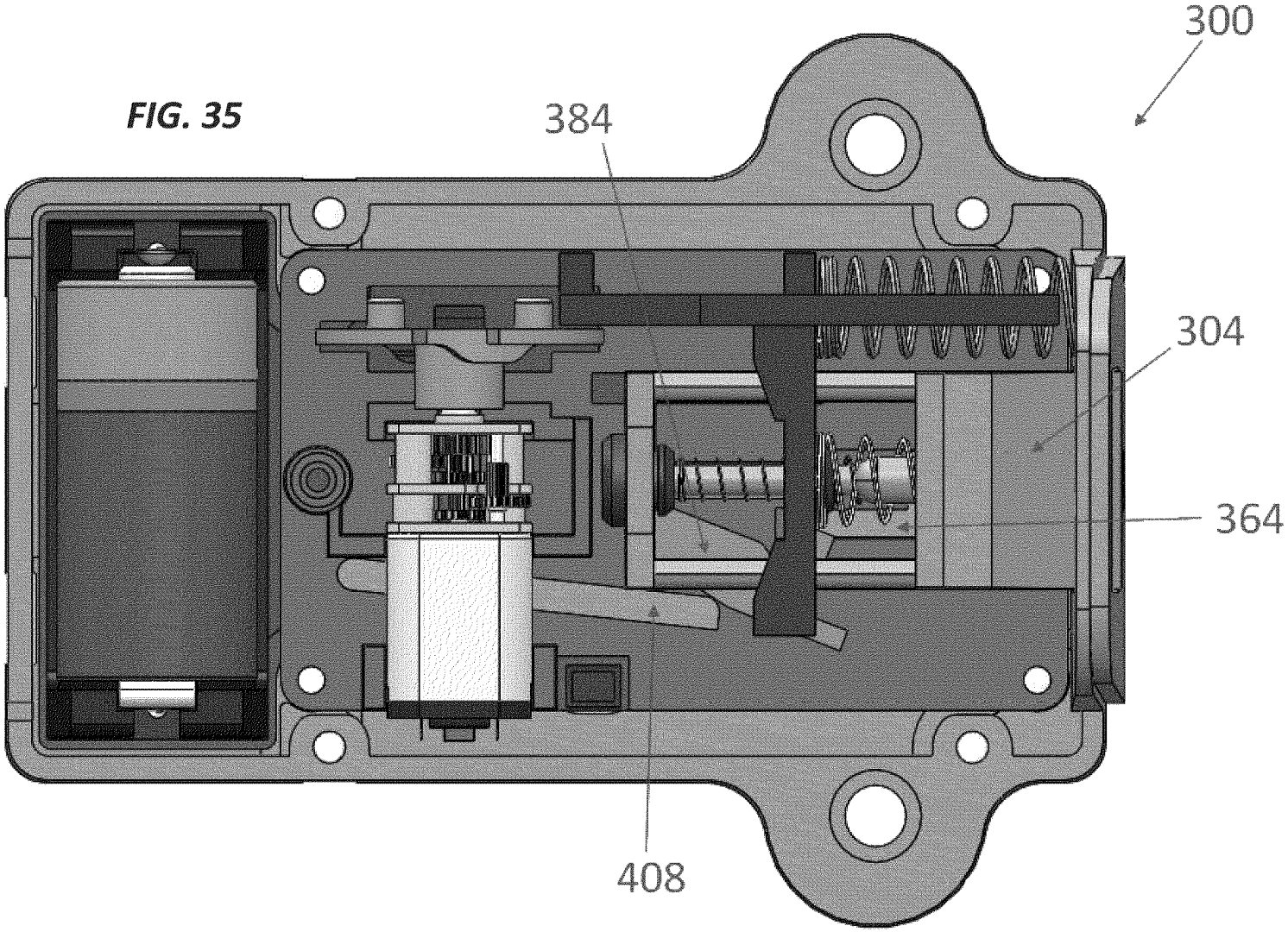
FIG. 35 is a sectional view of the push to close lock of FIG. 18 in a door closing arrangement according to one construction.

As shown in FIG. 35, the lock 300 is in the locked arrangement and the locker door is being closed. The angled face 308 of the bolt 304 engages a strike plate and is urged toward the retracted position. The deadbolt shoulder 372 engages the deadbolt shaft slot 304*a* of the bolt 304 such that the blocker arm 384 is arranged in the unlocked position. As the bolt 304 and the deadbolt 364 continue to retract, the blocker arm 384 engages the deadlocking lever 408 and displaces the deadlocking lever 408 to the unlocked position so that the bolt 304 can move fully to the retracted position.

Figure 36:
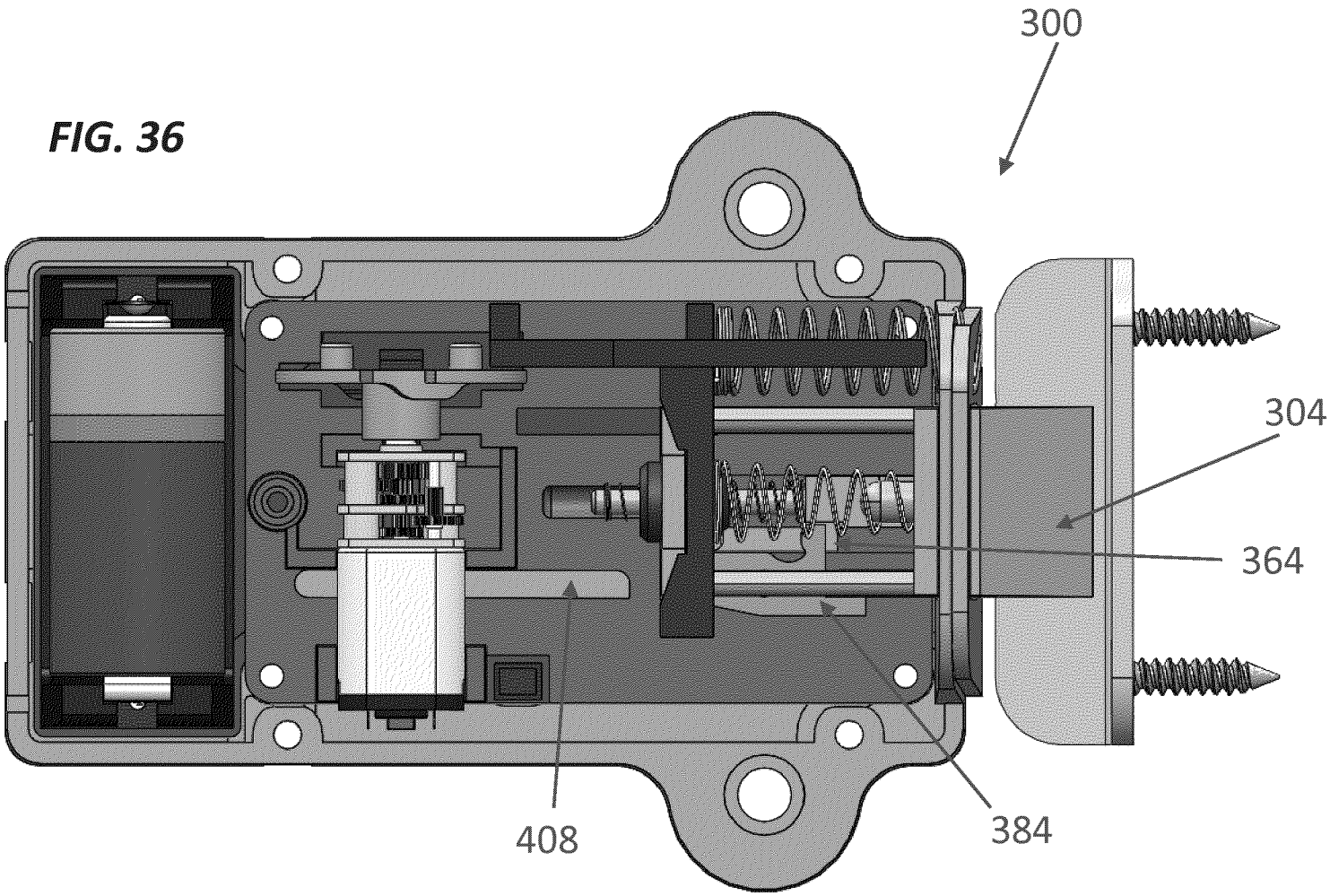
FIG. 36 is a sectional view of the push to close lock of FIG. 18 in a locked arrangement according to one construction.

As shown in FIG. 36, when the bolt 304 clears an opening in the strike plate, the bolt 304 extends and the lock 300 is arranged in the locked position with the locker door closed. With the locker door closed, the strike plate inhibits the deadbolt 364 from moving to the extended position so that the deadbolt shoulder 372 is not engaged with the bolt 304 and the deadbolt 364 is separated from the bolt 304. The deadbolt cam follower 380 engages the second lever 398 and moves the blocker arm 384 to the deadlocked position so that the bolt 304 is inhibited from moving to the retracted position by the deadlocking lever 408 and the blocker arm 384.

Figure 37:
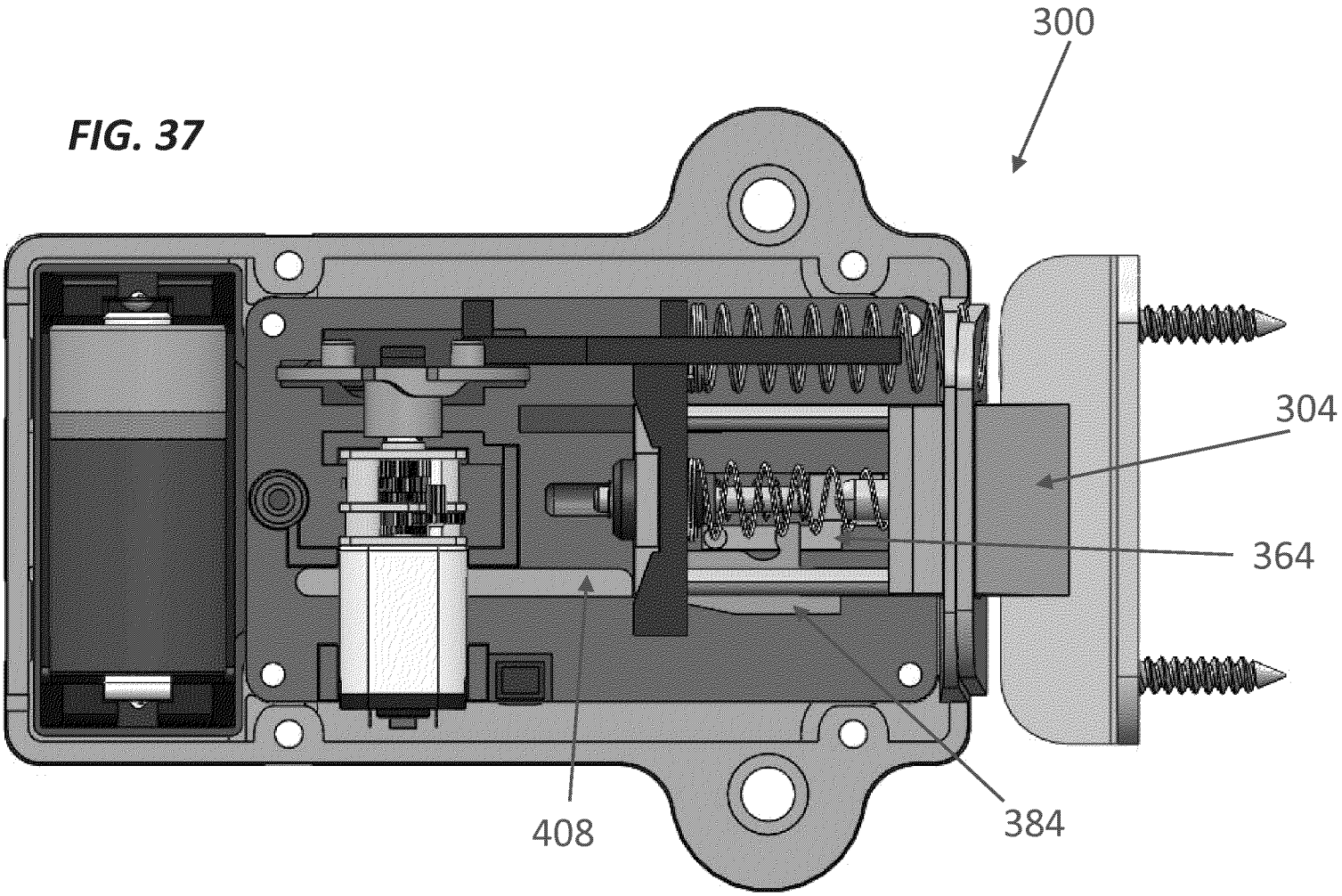
FIG. 37 is a sectional view of the push to close lock of FIG. 18 in a shimming arrangement according to one construction.

As shown in FIG. 37, in the event of an attempt to move the bolt 304 to the retracted position while the lock 300 is in the locked arrangement (e.g., by shimming), the deadlocking system inhibits the retraction of the bolt 304. The blocker arm 384 contacts the deadlocking lever 408 and retraction is inhibited.

Figure 38:
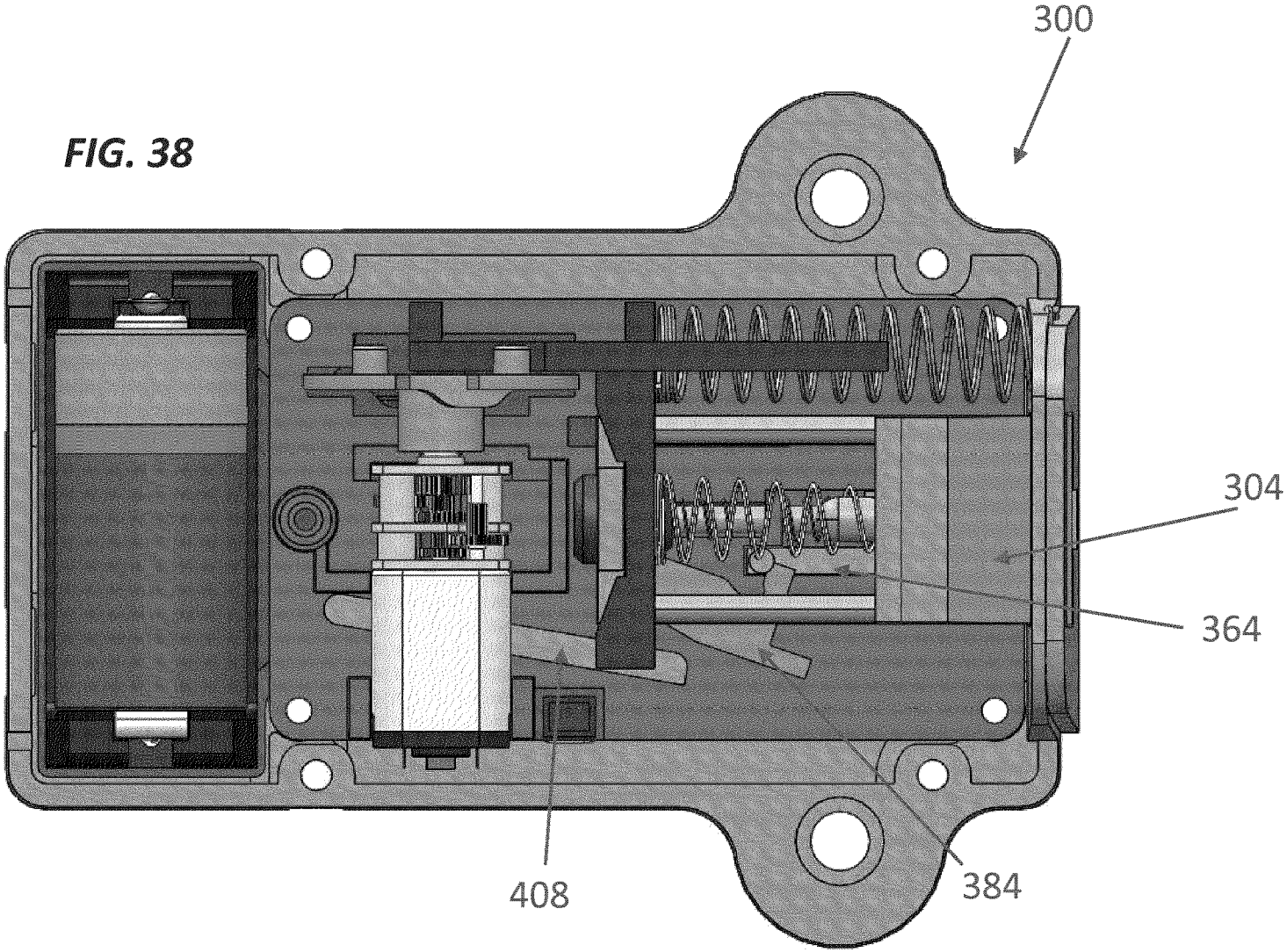
FIG. 38 is a sectional view of the push to close lock of FIG. 18 in an unlocked arrangement according to one construction.

As shown in FIG. 38, when the user wishes to open the locker door, the lock 300 is arranged in the unlocked position with the deadlocking lever 408 in the unlocked position. This allows the bolt 304 to move to the retracted position as the blocker arm 384 moves past the deadlocking lever 408.

The construction and arrangement of the systems, and methods as shown in the various examples are illustrative only. Although only a few constructions have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative constructions. Other substitutions, modifications, changes, and omissions may be made in the design, operating conditions and arrangement of the exemplary constructions without departing from the scope of the disclosure.

The disclosure contemplates methods, systems and program products on any machine-readable media for accomplishing various operations. The exemplary constructions of the disclosure may be implemented using existing computer processors, or by a special purpose computer processor for an appropriate system, incorporated for this or another purpose, or by a hardwired system. Constructions within the scope of the disclosure can include program products comprising machine-readable media (e.g., tangible and/or non-transitory) for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, flash memory, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A lock comprising:

an actuator movable between an unlocked position and a locked position and including a motor and a cam head defining a cam profile and including a protrusion;

a bolt movable between an extended bolt position and a retracted bolt position independent of the position of the actuator, wherein, in the extended bolt position, the bolt extends outside a body of the lock;

a coupling element arranged between the actuator and the bolt and movable between an extended coupling position and a retracted coupling position in response to movement of the actuator between the locked position and the unlocked position, wherein the cam head of the actuator is arranged to contact the coupling element;

a first biasing element biasing the coupling element toward the retracted coupling position;

a second biasing element coupling the coupling element to the bolt and structured to bias the bolt away from the coupling element and towards the extended bolt position; and a deadlocking lever that inhibits the bolt from moving from the extended bolt position to the retracted bolt position, and wherein the protrusion of the cam head moves the deadlocking lever such that the bolt is not inhibited from moving from the extended bolt position to the retracted bolt position when the actuator is in the unlocked position.

2. The lock of claim 1, wherein the protrusion is a first protrusion, and wherein the cam head includes a second protrusion and a third protrusion located at opposing positions on the cam head and both structured to contact the coupling element to move the coupling element between the extended coupling position and the retracted coupling position.

3. The lock of claim 2, wherein the cam head includes a circular portion from which the second protrusion and the third protrusion extend, the motor structured to cause one full rotation of the circular portion for every two locking cycles during which the actuator is moved between the unlocked position and the locked position and back to an original position, the motor structured to move the cam head in a single direction, the cam head structured such that the second protrusion contacts the coupling element during a first locking cycle and the third protrusion contacts the coupling element during a second locking cycle occurring after the first locking cycle.

4. The lock of claim 1, wherein the coupling element includes an unlocking coupling element, wherein the bolt includes an unlocking bolt element, and wherein the bolt is biased toward the bolt retracted position via engagement of the unlocking coupling element with the unlocking bolt element.

5. The lock of claim 1, wherein during a locking jam condition in which the actuator is in the locked position, the coupling element is urged into the extended coupling position by the actuator while the bolt is held by an external force in the retracted bolt position or a position between the retracted bolt position and the extended bolt position, wherein, upon removal of the external force, the bias of the second biasing element causes the bolt to extend to the extended bolt position.

6. The lock of claim 1, wherein during an unlocking jam condition in which the actuator is in the unlocked position, the coupling element is urged towards the retracted coupling position by the first biasing element while the bolt is held by an external force in the extended bolt position or a position between the retracted bolt position and the extended bolt position, wherein, upon removal of the external force, the biases of the first biasing element and the second biasing element cause the bolt to retract to the retracted bolt position.

7. The lock of claim 6, wherein during the unlocking jam condition, the actuator is not in contact with the coupling element.

8. An electronic locker lock comprising:

an interface assembly including a user input device, a controller, and a display providing user feedback;

a latching assembly including a power source, an actuator movable between a locked position and an unlocked position, a bolt actuatable between an extended bolt position and a retracted bolt position independent of the position of the actuator, and a coupling element coupled between the actuator and the bolt and arranged to urge the bolt toward the retracted bolt position when the actuator is arranged in the unlocked position and to urge the bolt toward the extended bolt position when the actuator is arranged in the locked position;

a first sensor structured to communicate an actuator position signal to the controller; and a second sensor structured to communicate a bolt position signal to the controller, wherein the controller is configured to generate a notification on the display to notify a user of a jam condition when the actuator position signal indicates that at least one of:

the actuator is in the locked position and the bolt position signal indicates the bolt is in the retracted bolt position, or the actuator is in the unlocked position and the bolt position signal indicates the bolt is in the extended bolt position.

9. The electronic locker lock of claim 8, wherein the second sensor includes a first bolt position sensor providing a first signal indicating the bolt is arranged in the retracted bolt position, and a second bolt position sensor providing second signal indicating the bolt is arranged in the extended bolt position.

10. The electronic locker lock of claim 8, wherein the display comprises a bi-stable electrophoretic display structured to enter a state using electrical power and maintain the state without continued electrical power.

11. The electronic locker lock of claim 8, wherein the controller is structured to communicate wirelessly with a mobile device.

12. The electronic locker lock of claim 11, wherein the controller is structured to receive an unlock command from the mobile device.

13. The electronic locker lock of claim 11, wherein the display indicates when the mobile device is communicating with the electronic locker lock via a wireless communication protocol.

14. The electronic locker lock of claim 8, further comprising a keyfob structured to interact with the controller to cause the actuation of the bolt.

15. An electronic locker lock comprising:

an interface assembly including a user input device, a controller, and a display providing user feedback;

a latching assembly including a power source, an actuator movable between an unlocked position and a locked position, a bolt movable between an extended bolt position and a retracted bolt position independent of the position of the actuator, wherein, in the extended bolt position, the bolt extends outside a body of the lock, a coupling element arranged between the actuator and the bolt and movable between an extended coupling position and a retracted coupling position in response to movement of the actuator between the locked position and the unlocked position, a first biasing element biasing the coupling element toward the retracted coupling position, and a second biasing element coupling the coupling element to the bolt and structured to bias the bolt away from the coupling element and towards the extended bolt position;

a first sensor structured to communicate an actuator position signal to the controller;

a first bolt position sensor structured to communicate a first bolt position signal to the controller; and a second bolt position sensor structured to communicate a second bolt position signal to the controller, wherein the controller is configured to generate a notification on the display to notify a user of a jam condition when the actuator position signal indicates that at least one of:

the actuator is in the locked position and the bolt position signal indicates the bolt is in the retracted bolt position, or the actuator is in the unlocked position and the bolt position signal indicates the bolt is in the extended bolt position.

16. A lock comprising:

an actuator movable between an unlocked position and a locked position;

a bolt movable between an extended bolt position and a retracted bolt position independent of the position of the actuator, wherein, in the extended bolt position, the bolt extends outside a body of the lock;

a coupling element arranged between the actuator and the bolt and movable between an extended coupling position and a retracted coupling position in response to movement of the actuator between the locked position and the unlocked position;

a first biasing element biasing the coupling element toward the retracted coupling position; and a second biasing element coupling the coupling element to the bolt and structured to bias the bolt away from the coupling element and towards the extended bolt position, wherein during a locking jam condition in which the actuator is in the locked position, the coupling element is urged into the extended coupling position by the actuator while the bolt is held by an external force in the retracted bolt position or a position between the retracted bolt position and the extended bolt position, wherein, upon removal of the external force, the bias of the second biasing element causes the bolt to extend to the extended bolt position.

17. A lock comprising:

an actuator movable between an unlocked position and a locked position;

a bolt movable between an extended bolt position and a retracted bolt position independent of the position of the actuator, wherein, in the extended bolt position, the bolt extends outside a body of the lock;

a coupling element arranged between the actuator and the bolt and movable between an extended coupling position and a retracted coupling position in response to movement of the actuator between the locked position and the unlocked position;

a first biasing element biasing the coupling element toward the retracted coupling position; and a second biasing element coupling the coupling element to the bolt and structured to bias the bolt away from the coupling element and towards the extended bolt position, wherein during an unlocking jam condition in which the actuator is in the unlocked position, the coupling element is urged towards the retracted coupling position by the first biasing element while the bolt is held by an external force in the extended bolt position or a position between the retracted bolt position and the extended bolt position, wherein, upon removal of the external force, the biases of the first biasing element and the second biasing element cause the bolt to retract to the retracted bolt position.

18. The lock of claim 17, wherein during the unlocking jam condition, the actuator is not in contact with the coupling element.

* * * * *